US007980451B2

(12) United States Patent
Yost et al.

(10) Patent No.: US 7,980,451 B2
(45) Date of Patent: Jul. 19, 2011

(54) SINGLE-PLY PRESSURE SEAL MAILER WITH REMOVABLE PULL TAB

(75) Inventors: David Yost, Roanoke, VA (US); Andrew Harnett, Englewood, NJ (US)

(73) Assignee: Infoseal, LLC, Englewood, NJ (US)

( * ) Notice: Subject to any disclaimer, the term of this patent is extended or adjusted under 35 U.S.C. 154(b) by 716 days.

(21) Appl. No.: 11/975,359

(22) Filed: Oct. 17, 2007

(65) Prior Publication Data

US 2009/0101697 A1 Apr. 23, 2009

(51) Int. Cl.
*B65D 27/00* (2006.01)
*B65D 27/34* (2006.01)

(52) U.S. Cl. ..... 229/92.1; 229/313

(58) Field of Classification Search ..... 229/92.1, 229/92.3, 301, 303–305, 313
See application file for complete search history.

(56) References Cited

U.S. PATENT DOCUMENTS

| | | | | |
|---|---|---|---|---|
| 3,995,808 | A * | 12/1976 | Kehoe | 229/305 |
| 4,044,942 | A * | 8/1977 | Sherwood | 229/305 |
| 4,157,759 | A | 6/1979 | Dicker | |
| 4,384,670 | A | 5/1983 | Dicker | |
| 5,114,067 | A | 5/1992 | Martin et al. | 229/92.1 |
| 5,785,242 | A * | 7/1998 | Lombardo | 229/305 |
| 6,962,372 | B2 * | 11/2005 | Fabel et al. | 283/116 |

FOREIGN PATENT DOCUMENTS

GB 2269803 A 2/1994

* cited by examiner

*Primary Examiner* — Jes F Pascua
(74) *Attorney, Agent, or Firm* — Mintz Levin Cohn Ferris Glovsky and Popeo, PC

(57) ABSTRACT

A business form or intermediate is provided constructed from a single ply, wherein one or more inserts are formed from the same single ply. The business form or business form intermediate includes a removable pull tab that is manually removed from the form or intermediate with a single manual motion. Removal of the pull lab releases the one or more inserts from the form or intermediate to permit removal of the one or more inserts therefrom.

3 Claims, 32 Drawing Sheets

SINGLE-PLY PRESSURE SEAL MAILER WITH REMOVABLE PULL TAB

TECHNICAL FIELD

The invention relates to a single ply pressure seal form and, more particularly, to a single ply pressure seal form configured as a business form or business form intermediate that contains and permits extraction of one or more inserts die cut from and contiguous with the single ply. The invention also relates to the business form or business form intermediate further configured with a removable pull tab that creates, when removed with a single manual motion, a single opening to permit removal of the one or more inserts.

BACKGROUND

Various types of prior art business forms and business form intermediates are constructed as a mailer form or mailer form intermediate designed to contain within its interior one or more insert plies for mailing to recipients. Such insert plies are often configured as, for instance, invoices, payment slips, response cards, rebate coupons and other forms, as well as are often configured as return envelopes for containing and mailing one or more insert plies that a recipient would return to the sender. Many of such forms and intermediates require the removal of tear-off stub or margin portions or strips that are defined along the sides and either the top or bottom of such forms and intermediates by one or more lines of weakening or perforations, which permit the side and either the top or bottom portions or strips to be manually torn or otherwise removed from the forms and intermediates. Tear-off portions or strips are typically defined by or configured with applications of adhesive, such that, removal of the tear-off portions or strips helps to facilitate opening of the forms and intermediates, as well as exposing one or more insert plies contained within the interior of such forms and intermediates.

However, manual tearing or removing of such stub or margin portions or strips from forms or intermediates in many instances is cumbersome, inefficient, requires multiple folding and tearing for complete removal, and often causes damage to the one or more insert plies contained within the forms or intermediates. In addition, many prior art forms and intermediates that contain insert plies are typically constructed of two or more plies of various types of paper that are secured by placement of any of a variety of adhesives, including wet or thermal-activated adhesives. Such multi-ply forms and intermediates are not compatible with modern imaging technology and techniques such as, for instance, laser or ink jet technology and printing techniques. Also, multi-ply forms and intermediates as described above may often be difficult and expensive to produce due to the materials costs involved and the manufacturing steps required to construct a multi-ply form or intermediate configured to contain one or more insert plies.

SUMMARY

An object of the invention is to provide a business form or business form intermediate constructed of a single ply, wherein one or more inserts are formed from the same single ply.

Another object of the invention is to construct a business form or business form intermediate with a removable pull tab that is manually removed from the form or intermediate with a single manual motion and with ease and efficiency, as well as without damaging the one or more inserts contained therein.

A further object of the invention is to construct a business form or business form intermediate with the removable pull tab such that removal of the pull tab releases the one or more inserts from the form or intermediate to permit removal of the one or more inserts therefrom.

Another object of the invention is to provide a business form or business form intermediate constructed to be affixed to a package, container or other surface having a removable pull tab defined along a front or outward face that permits opening of the form or intermediate without requiring removal of the form or intermediate from the package, container or other surface, and without requiring removal of tear-off stub or margin portions or strips in order to expose and to remove one or more inserts, such as a packing slip, contained within the interior of the form or intermediate.

Another object of the invention is to provide a business form or business form intermediate including one or more inserts that are contiguous with a singly ply defining the form or intermediate and that are folded during configuration of the form or intermediate such that the one or more inserts are contained within the interior of the form or intermediate without use of adhesive or cohesive.

A further object of the invention is to provide a business form or business form intermediate, as described, using applications of pressure sensitive cohesive to produce secure bonding along certain side or other portions of the form or intermediate, avoiding contact of cohesive with the interior area of the form or intermediate available for printing.

In general, in an aspect, the invention provides a business form or intermediate comprising a single ply having a front or first face and a back or second face for receiving information thereon and having a top edge, a bottom edge, a first side edge and a second side edge, the single ply having a body portion defining one or more panels. The form or intermediate includes an insert portion disposed along one edge of said body portion and defining one or more panels, the insert portion having a width less than a width of one of the one or more panels of said body portion. The form or intermediate also includes a first application of cohesive disposed vertically on the one or more panels of the body portion adjacent to the first side edge along the back or second face and a second application of cohesive disposed vertically on the one or more panels of the body portion adjacent to the second side edge along the back or second face. The form or intermediate further includes a first pull tab defined by adjacent lines of weakness extending transversely along at least a portion of the width of one panel of the body portion, one line of weakness disposed between the one panel of the body portion and one panel of the insert portion. The body portion and the insert portion, when folded, construct the business form or intermediate and enclose the first pull tab within the interior of the business form or intermediate. The first pull tab is exposed when the business form or intermediate is opened or unfolded and removal of the first pull tab releases at least the one panel of the insert portion.

Implementations of the invention can include one or more of the following features. The business form or intermediate further comprises a third application of cohesive disposed horizontally along at least a portion of the width of the body portion proximate and adjacent to the top edge and a fourth application of cohesive disposed horizontally along at least a portion of the width of the body portion. At least a portion of the third and fourth applications of cohesive mate and bond together when the body portion and insert portion are folded into the business form or intermediate. The business form or intermediate also comprises a second pull tab defined by adjacent lines of weakness extending transversely along at least a portion of the width of the body portion adjacent to the top edge. When the business form or intermediate is folded, the second pull tab is disposed along the exterior of the business form or intermediate such that removal of the second pull tab from the business form or intermediate exposes the first pull tab.

In another aspect, the invention provides a business form or intermediate comprising a single ply having a front or first face and a back or second face for receiving information thereon and having a top edge, a bottom edge, a first side edge and a second side edge, the single ply having a body portion defining one or more panels. The business form or intermediate further includes an insert portion disposed along one edge of the body portion that defines one or more panels. The insert portion has a width less than a width of one of the one or more panels of the body portion. The form or intermediate also includes a first application of cohesive disposed vertically on the one or more panels of the body portion adjacent to the first side edge along the back or second face and a second application of cohesive disposed vertically on the one or more panels of the body portion adjacent to the second side edge along the back or second face. The form or intermediate includes a first pull tab defined by adjacent lines of weakness extending transversely along at least a portion of the width of one panel of the body portion adjacent to one panel of the insert portion. One of the lines of weakness is disposed between the one panel of the body portion and the one panel of the insert. The first pull tab has a third application of cohesive disposed between said adjacent lines of weakness. The form or intermediate also includes a second pull tab defined by adjacent lines of weakness extending transversely along at least a portion of the width of the body portion and adjacent to the top edge. The second pull tab has a fourth application of cohesive disposed between the lines of weakness. The body portion and the insert portion, when folded, construct the business form or intermediate, and at least a portion of the third application of cohesive mate with and bonds to at least a portion of the fourth application of cohesive to bond the first and second pull tabs. The first pull tab is contained within the interior of the business form or intermediate and the second pull tab is disposed along the exterior of the business form or intermediate. Removal of the second pull tab from the business form or intermediate removes the first pull tab from the insert portion to release at least one panel of the insert portion from within the interior of the business form or intermediate.

In further aspect, the invention provides a business form or intermediate comprising a single ply having a front or first face and a back or second face for receiving information thereon and having a top edge, a bottom edge, a first side edge and a second side edge, the single ply having a body portion defining one or more panels. The business form or intermediate further includes an insert portion disposed along one edge of the body portion and that defines one or more panels. The insert portion has a width less than a width of one of the one or more panels of the body portion. The business form or intermediate also includes a first application of cohesive disposed vertically on the one or more panels of the body portion adjacent to the first side edge along the back or second face and a second application of cohesive disposed vertically on the one or more panels of the body portion adjacent to the second side edge along the back or second face. The business form or intermediate includes a first pull tab defined by adjacent lines of weakness extending transversely along at least a portion of the width of one panel of the insert portion. One of the lines of weakness is disposed between the one panel of the insert portion and one panel of the body portion. The first pull tab has a third application of cohesive disposed between the adjacent lines of weakness. The business form or intermediate further includes a second pull tab defined by the top edge and a line of weakness extending transversely along at least a portion of the width of the body portion and adjacent to the top edge. The second pull tab has a fourth application of cohesive disposed between the top edge and the line of weakness. The body portion and the insert portion, when folded, construct the business form or intermediate and at least a portion of the third application of cohesive mates with and bonds to at least a portion of the fourth application of cohesive to bond the first and second pull tabs. The first pull tab is contained within the interior of the business form or intermediate and the second pull tab is disposed along the exterior of the business form or intermediate. Removal of the second pull tab from the business form or intermediate removes the first pull tab from the insert portion to release at least one panel of the insert portion from within the interior of the business form or intermediate.

In still another aspect, the invention provides a business form or intermediate comprising a single ply having a front or first face and a back or second face for receiving information thereon and having a top edge, a bottom edge, a first side edge and a second side edge, the single ply having a body portion defining one or more panels. The business form or mailer further includes an insert portion disposed along one edge of the body portion and defining one or more panels. The insert portion has a width less than a width of one of the one or more panels of the body portion. The business form or intermediate includes a first application of cohesive disposed vertically on the one or more panels of the body portion adjacent to the first side edge along the back or second face and a second application of cohesive disposed vertically on the one or more panels of the body portion adjacent to the second side edge along the back or second face. The business form or intermediate also includes a first pull tab defined by adjacent lines of weakness extending transversely along at least a portion of the width of one panel of the insert portion. One of the lines of weakness is disposed between the one panel of the insert portion and one panel of the body portion. The first pull tab has a third application of cohesive disposed between the adjacent lines of weakness. The business form or intermediate further includes a second pull tab defined by adjacent lines of weakness extending transversely along at least a portion of the width of the body portion and adjacent to the top edge. The second pull tab has a fourth application of cohesive disposed between the lines of weakness. The body portion and the insert portion, when folded, construct the business form or intermediate and at least a portion of the third application of cohesive mates with and bonds to at least a portion of the fourth application of cohesive to bond the first and second pull tabs. The first pull tab is contained within the interior of the business form or intermediate and the second pull tab is disposed along the exterior of the business form or intermediate. Removal of the second pull tab from the business form or intermediate removes the first pull tab from the insert portion to release at least one panel of the insert portion from within the interior of the business form or intermediate.

Various aspects of the invention may provide one or more of the following capabilities or advantages. A pressure seal business form or business form intermediate can be constructed from a single ply and can include one or more inserts for mailing to a recipient. The form or intermediate can be constructed such that the one or more inserts are formed from the single ply, e.g., by die cutting portions of the single ply, and are contiguous with other portions of the form or intermediate. The one or more inserts can define a width that is less than the width of at least a portion of other non-insert portion(s) of the form or intermediate. The one or more inserts can thereby be folded into and contained within the interior of the form or intermediate without application of cohesive or adhesive to the one or more inserts.

The form or intermediate can include a removable pull tab defined along one surface or face of the form or intermediate that can be disposed and configured for opening the form or intermediate when removed therefrom. The pull tab can be constructed such that its removal from the form or intermediate is achieved with a single manual motion. In addition, the pull tab can be constructed such that, when the pull tab is removed from the form or intermediate, the pull tab simultaneously releases one or more inserts contained within the interior of the form or intermediate thereby enabling removal of the one or more inserts. The pull tab can include cohesive disposed along a portion of its surface such that when the form or intermediate are folded into a desired configuration the cohesive along the pull tab mates with and bonds to at least a portion of cohesive disposed along a pull tab defined in at least one insert contained within the form or intermediate. When the pull tab is removed from the form or intermediate, the pull tab simultaneously removes the insert pull tab to which it is bonded to thereby release the one or more inserts contained within the interior of the form or intermediate.

Alternatively, the pull tab of the form or intermediate can be configured without including cohesive and can be defined in the form or intermediate such that the pull tab and an underlying pull tab defined in at least one insert are not bonded but are disposed separately when the form or intermediate is folded into a desired configuration. In this case, removal of the pull tab is independent from removal of the insert pull tab and may serve to open the form or intermediate and to expose the insert pull tab for removal from the form or intermediate. Removal of the insert pull tab can release the one or more inserts.

In a further alternative, the form or intermediate may include a closure tab defined along one edge of the form or intermediate, e.g. along a top or a bottom edge, constructed to fold over the edge in a manner similar to an envelope flap. Opening or separating the closure tab from the folded form or intermediate can expose an underlying pull tab defined along at least one insert contained within the form or intermediate to enable removal of the underlying pull tab.

In a further configuration of the tab closure, the tab closure can include a pull tab defined therein that is similar to the pull tab described above, whereby the pull tab includes cohesive disposed along the pull tab such that when the form or intermediate is folded in a desired configuration, the pull tab along the closure tab and an underlying pull tab defined along at least one insert mate with and bond to one another. In this case, removal of the pull tab bonded with the underlying insert pull tab can cause the simultaneous removal of the insert pull tab to thereby release the one or more inserts contained within the form or intermediate.

The various configurations of the singly ply business form or intermediate described above can be a single ply construction that is conducive to applications of pressure sensitive cohesive and conducive to laser imaging and printing technology and techniques. The various configurations of the removable pull tab can eliminate the need for tear-off stub or margin portions or strips to open a form or intermediate and can help to increase the efficiency of opening the form or intermediate by requiring only a single manual motion to remove the pull tab. The various configurations of the removable pull tab can thereby help to reduce the number of manual folds and/or motions, e.g., up to five to six folds and/or motions, that are typically required to remove tear-off stub or margin portions or strips to open prior art forms and intermediates. In addition, the various configurations of the removable pull tab described above can be constructed to permit opening of the form or intermediate along a single edge or end of the form or intermediate, such as, for instance, along a top or bottom edge or end, to help to facilitate efficient opening of the form or intermediate and to release of the one or more contained inserts. Further, the various configurations of the removable pull tab described above can simultaneously release one or more inserts contained within the form or intermediate when the pull tab is removed from the form or intermediate. The various configurations of the removable pull tab can further help to reduce the risk of damage to the one or more inserts during opening of a form or intermediate.

The invention will be more fully understood after a review of the following figures, detailed description and claims.

BRIEF DESCRIPTION OF THE DRAWINGS

The drawings are not drawn to scale and illustrate certain aspects and features of the invention without intending to limit or without limiting the scope of the invention.

DETAIL DESCRIPTION

The invention provides a single ply pressure seal business form or business form intermediate that may be constructed, for instance, as a mailer, shipping/packaging list form or other configuration for mailing one or more inserts contained therein. The business form or intermediate comprises a single ply of any of various types of paper substrate, application(s) of pressure seal cohesive to secure the single ply when folded, and a removable pull tab configured to permit opening of the form or intermediate with ease and efficiency and without damage to the contained insert(s). The pull tab is also configured to permit opening of the form or intermediate along a single edge or end and preferably along a top or bottom edge of the form or intermediate. The pull tab is constructed and arranged such that pulling the tab along at least one line of suitable perforations causes the release of the pull tab from the form or intermediate and simultaneously the release of the contained insert(s) from the form or intermediate to thereby facilitate removal of the contained insert(s) from within the interior of the form or intermediate through its top or bottom edge. Alternatively, the pull tab can be constructed and arranged such that pulling the tab along at least one line of suitable perforations causes the removal of the pull tab from the form or intermediate. In this case, removal of this pull tab either exposes an underlying pull tab, defined in at least one insert contained within the interior of the form or intermediate that is configured to release one or more inserts when removed, or exposes one or more inserts for removal from the form or intermediate. The one or more inserts may be one or more portions or panels of the form or intermediate that are die cut from the single ply and have one or more dimensions, such as a width, that is less than a counterpart dimension, such as the width, of the form or intermediate to enable the insert(s) to be folded or otherwise contained within the interior of the form or intermediate. The form or intermediate may be folded into a C-fold, Z-fold or double parallel configuration and sealed via pressure sensitive cohesive. The invention also provides methods of forming the single ply pressure seal form or intermediate as described below. Other embodiments are within the scope of the invention.

The invention is described in terms of a "mailer" that refers to any type of business mailer or business mailer intermediate but also includes other business forms and business form intermediates, including, but not limited to, a direct mail piece, shipping/packing list form, envelope, coupon booklet or other configuration, that is constructed using folding and sealing techniques employing and compatible with pressure sensitive cohesive(s).

Figure 1A:
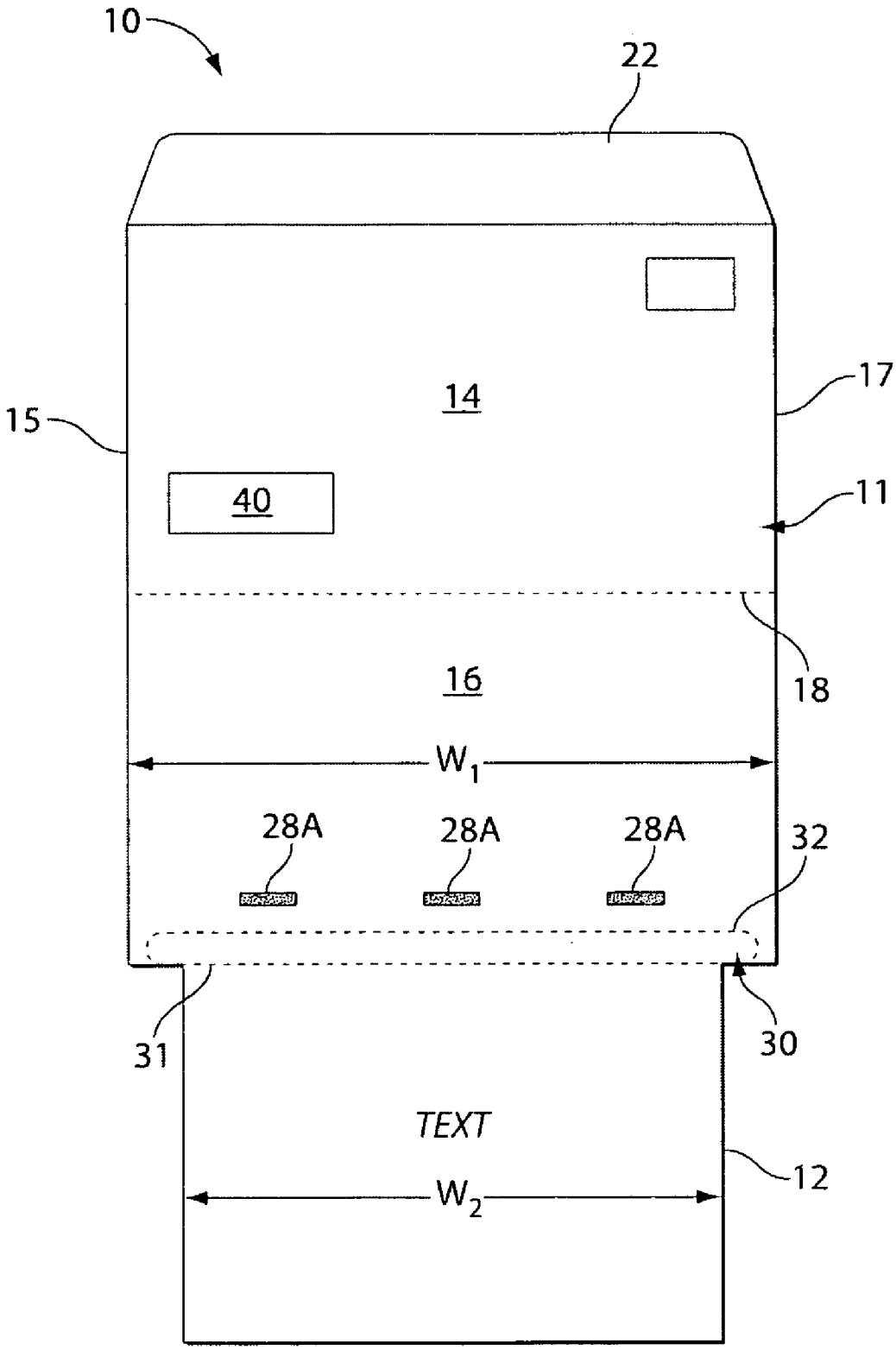
FIG. 1A illustrates a view of a front or first face of a single ply pressure seal business mailer with an insert according to one aspect of the invention.
Figure 1B:
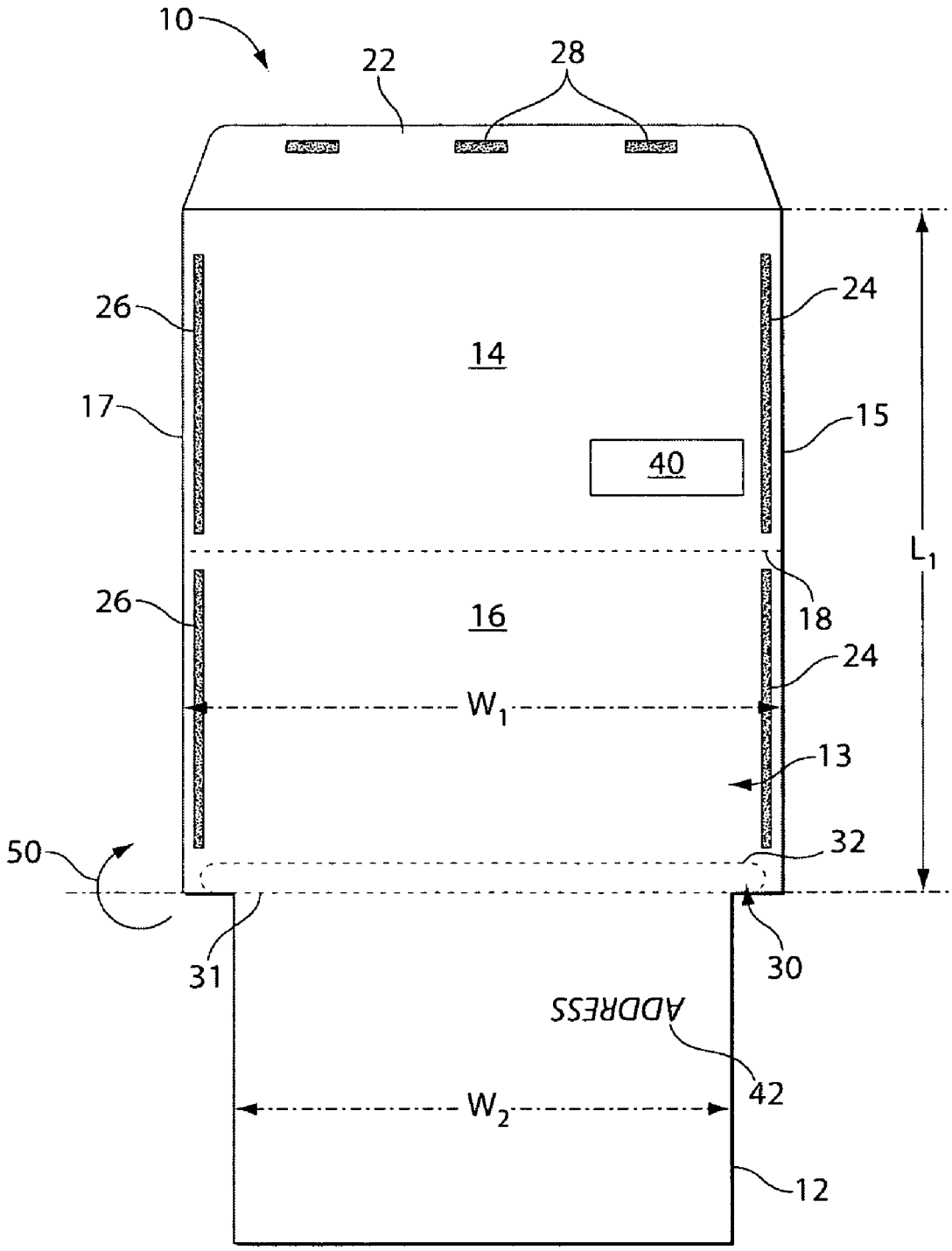
FIG. 1B illustrates a view of a back or second face of the mailer shown in FIG. 1A.

Referring to FIGS. 1A and 1B, in an aspect, the invention provides a mailer 10 including a single ply of any of a variety of papers and paper substrates that are suitable for constructing a mailer that may be printed by various methods known in the art. The single ply mailer 10 has a front or first face 11 and a back or second face 13 that define a first panel 14 and a second panel 16. The first and second panels 14 and 16 are further defined by a first fold line or line of suitable perforations 18 that separates the first panel 14 from the second panel 16. The single ply mailer 10 further defines at least one insert 12 that extends from one of the first and second panels 14 and 16. As shown in FIGS. 1A and 1B, in one configuration, such as a C-fold or a double parallel configuration, the insert 12 preferably extends from the second panel 16. The insert 12 is further defined by a line of suitable perforations 31 disposed between the second panel 16 and the insert 12. The mailer 10 also optionally includes a tab closure 22 that extends from the first panel 14 and is configured to help to seal the mailer 10 when folded as described below.

The single ply of the mailer 10 may have any required or desired dimensions to define the mailer 10 with any of a variety of configurations, such as, for instance, a rectangular configuration, as shown, for instance, in FIGS. 1A and 1B. The overall dimensions of the single ply mailer 10 can include, but are not limited to, overall dimensions in a range of from about 8.5 inches by about 11 inches; about 8.5 inches by about 14 inches; about 11 inches by 14 inches; about 11 inches by about 17 inches; and up to about 11 inches by about 18 inches and about 11.5 inches by about 28 inches for larger unique-sized mailers 10. The overall dimensions can depend upon any of a variety of laser printers known in the art that is used to image/print the mailer 10.

In addition, the first and second panels 14 and 16 may have similar or substantially equal dimensions, while the insert 12 has at least one dimension that is smaller or less than the counterpart dimension of the first and/or second panels 14 and 16 in order the insert 12 may fit within or between the first and second panels 14 and 16 when the mailer 10 is folded. For instance, as shown in FIGS. 1A and 1B, the insert 12 has a width $W_2$ that is smaller or less than the width $W_1$ of either the first or the second panel 14 and 16. During folding of the mailer 10, the insert 12 is folded along the line of perforations 31, as shown by arrow 50 in FIG. 2, to dispose the insert 12 in facing relation to the back or second face 13 and within or between the first and second panels 14 and 16. The larger width $W_1$ of the first and/or the second panels 14 and 16 relative to the width $W_2$ of the insert 12 helps to accommodate the size of the insert 12 and helps to ensure that the insert 12 is substantially contained within or between the panels 14 and 16. In addition, the size of the insert 12 relative to the mailer 10 helps the insert 12 avoid contact with pressure sensitive cohesive during application of such cohesive and folding of the mailer 10 into its final configuration.

The insert 12 is formed from the single ply of the mailer 10 by die cutting a portion of the mailer 10, e.g., a portion other than the first and second panels 14 and 16, to define the insert 12 with at least one dimension that is smaller or less than the counterpart dimension of the first and/or the second panels 14 and 16. Preferably, as described above, the insert 12 is die cut with a width $W_2$, that is smaller or less than a width $W_1$ of at least one of the first and second panels 14 and 16 to facilitate folding and containment of the insert 12 within the interior of the mailer 10 as described above.

Figure 1C:
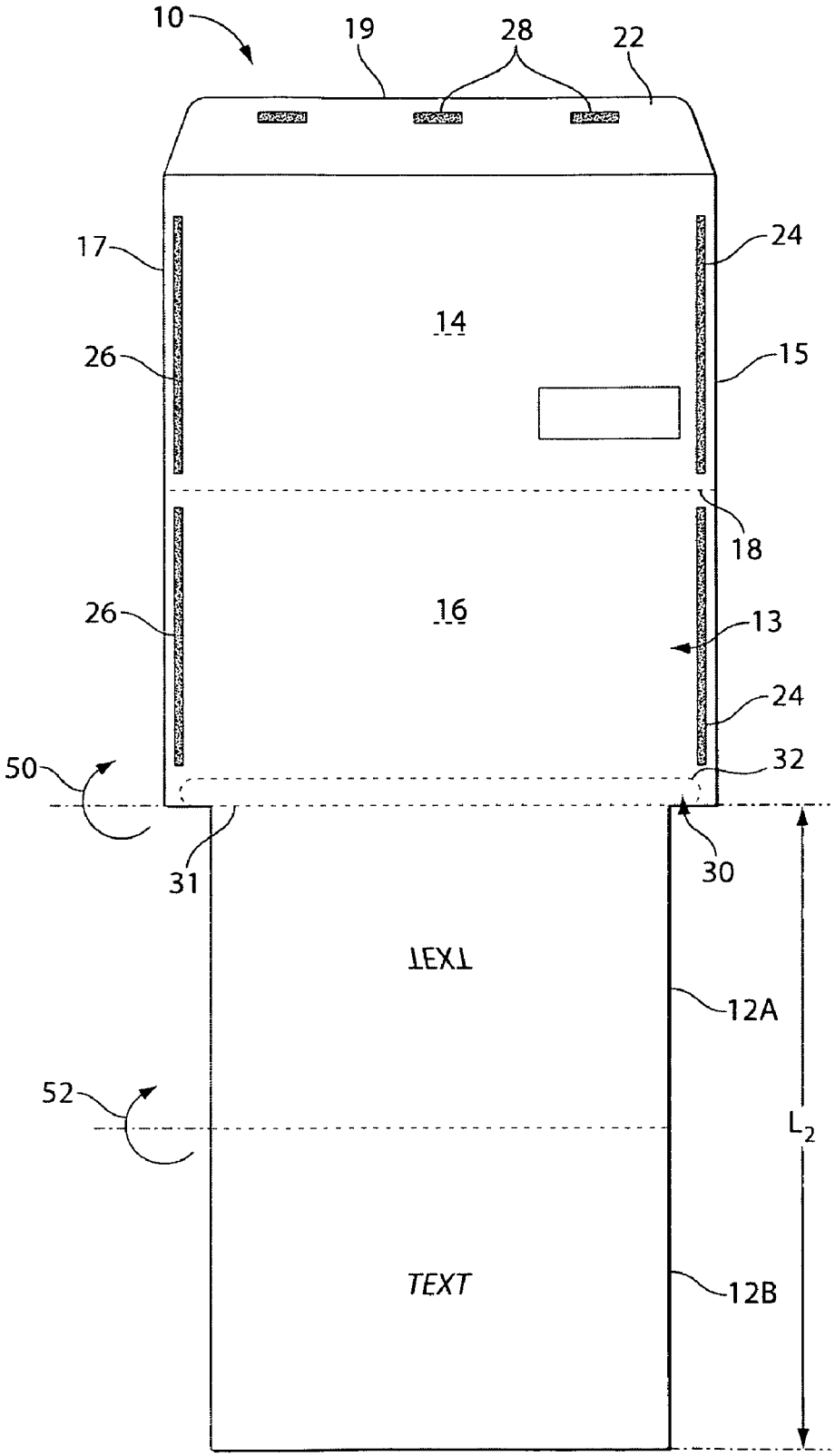
FIG. 1C illustrates a view of a back or second face of the mailer shown in FIGS. 1A and 1B adapted to accommodate an insert defining certain dimensions and having multiple panels.

Referring to FIG. 1C, and with further reference to FIGS. 1A and 1B, the insert 12 may comprise more than a single panel and may be configured with two or more equal or unequal panels 12A and 12B. In this case, the insert 12 would be folded about each panel 12A and 12B in order to reduce the length $L_2$ of the insert 12 such that when the insert 12 is folded about the line of perforations 31, as shown by arrow 50 in FIG. 1B, and into the first and second panels 14 and 16, the insert 12 is substantially contained within or between, e.g., the length $L_1$ of the panels 14 and 16. As shown by arrow 52 of FIG. 1C, one panel 12B may be folded in an upward orientation relative to a top 19 of the mailer 10 in facing relation to the other panel 12A of the insert 12 along the back or second side 13 of the mailer 10. Alternatively, as also shown by arrow 52 in FIG. 1C, one panel 12B may be folded in an upward orientation relative to the top 19 of the mailer 10 in facing relation to the other panel 12A of the insert 12 along the front or first side 11. In each case, the insert 12 is folded along itself and its length $L_2$ is thereby reduced in order the insert 12 may be accommodated by the first and second panels 14 and 16 as described above. Similarly, two or more panels 12A and 12B of the insert 12 may be Z-folded in order to reduce the length $L_2$ of the insert 12 such that the first and the second panels 14 and 16 accommodate the insert 12.

With further reference to FIGS. 1A-1C, the mailer 10 includes one or more vertical lines of pressure sensitive cohesive 24 disposed on the back or second face 13 of the mailer 10 that extend longitudinally along the first and the second panels 14 and 16 and proximate or adjacent to a first side edge 15 of the mailer 10. Similarly, the mailer 10 includes one or more vertical lines of pressure sensitive cohesive 26 disposed on the back or second face 13 that extend longitudinally along the first and the second panels 14 and 16 and proximate or adjacent to a second side edge 17 of the mailer 10. The one or more vertical lines of cohesive 24 and 26 along the first panel 14 are disposed such that when the first panel 14 is folded about the first fold line or line of perforations 18 toward the back or second face 13 of the mailer 10, at least a portion of the one or more vertical lines of cohesive 24 and 26 mate with at least a portion of the vertical lines of cohesive 24 and 26 along the second panel 16. One or both vertical lines of cohesive 24 and 26 may alternatively include dots or other shapes or configurations of cohesive rather than lines. In addition, one or both vertical lines of cohesive 24 and 26 may include a linear pattern of cohesive 24 and 26 whereby one or more lines, dots, or other shapes or configurations of cohesive are disposed along the first and the second panels 14 and 16, as described above, in a linear and repeating pattern arrangement. Alternatively, each vertical line of cohesive 24 and 26 may define a single line of cohesive 24 and 26 extending along the first and second panels 14 and 16, or may define multiple lines of cohesive 24 and 26 that are disposed along the first and second panels 14 and 16 in alternating positions, e.g., such that one line of cohesive 24 or 26 is immediately adjacent the side edge 15 or 17, respectively, and a subsequent and adjacent line of cohesive 24 or 26 is spaced from the side edge 15 or 17, respectively. The invention is not limited in this respect and anticipates various types of arrangements or patterns of vertical lines, dots or other configurations of cohesive 24 and 26 along the first and second panels 14 and 15 such that at least a portion of cohesive 24 and 26 disposed along the first panel 14 mates with at least a portion of cohesive 24 and 26 disposed along the second panel 16 to secure the mailer 10 adjacent to its side edges 15 and 17. Depending upon the application in which the mailer 10 is to be employed, the type of pressure sensitive cohesive 24 and 26 that is applied to the first and second panels 14 and 16 may fixedly secure the first and second panels 14 and 16 together.

As shown in FIGS. 1A-1C, the mailer 10 includes a pull tab 30 defined in the mailer 10 by lines of suitable perforations 31 and 32 between the insert 12 and the second panel 16 or, alternatively, between the insert 12 and a bottom or last panel of the mailer 10. Each line of perforations 31 and 32 is typically opposite and adjacent to the other line of perforations 31 and 32, as shown, and in some instances, the lines of perforations 31 and 32 are substantially parallel to one another, depending upon the configuration of the pull tab 30 and the application of the mailer 10. The lines of perforations 31 and 32 are defined through the single ply, e.g., through the front and the back faces 11 and 13, of the mailer 10. In addition, the lines of perforations 31 and 32 may define the pull tab 20 to extend beyond outer edges of the insert 12. Further, the pull tab 20 may be configured to completely or partially traverse the mailer 10 either widthwise or lengthwise, depending upon the ultimate configuration and application of the mailer 10.

Figure 1D:
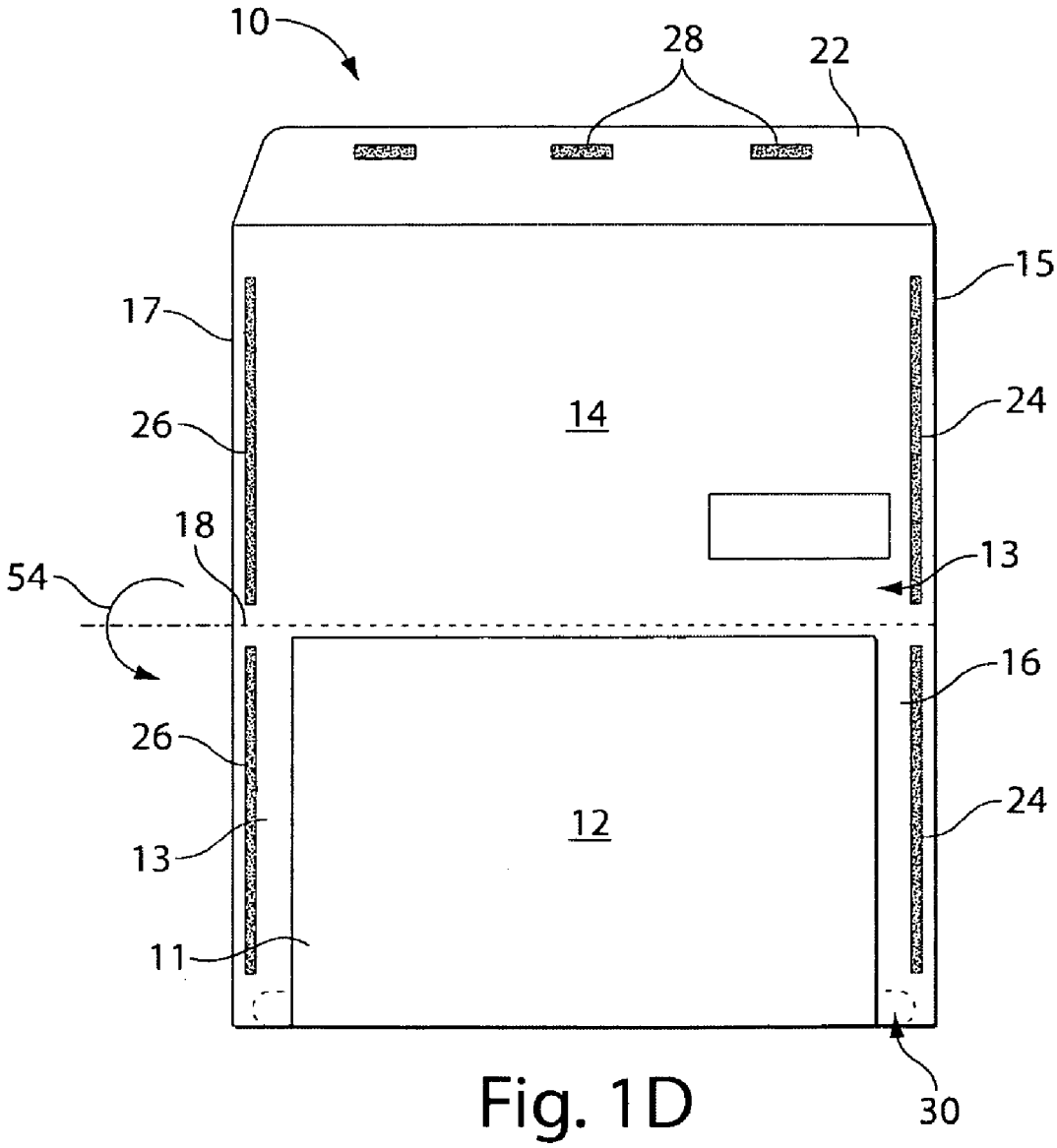
FIGS. 1D-1H illustrate views of the mailer shown in FIGS. 1A-1C at different phases of folding and opening.
Figure 1E:
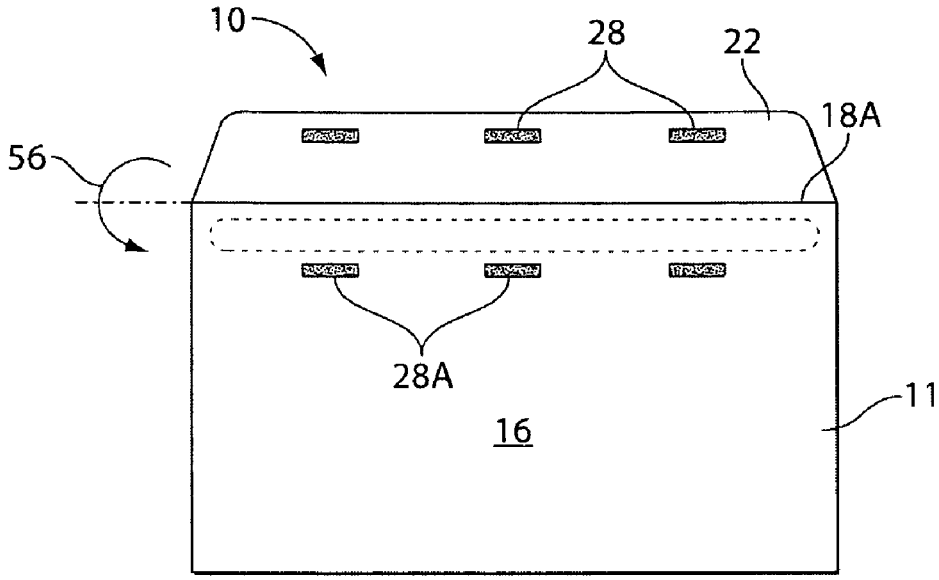
Figure 1F:
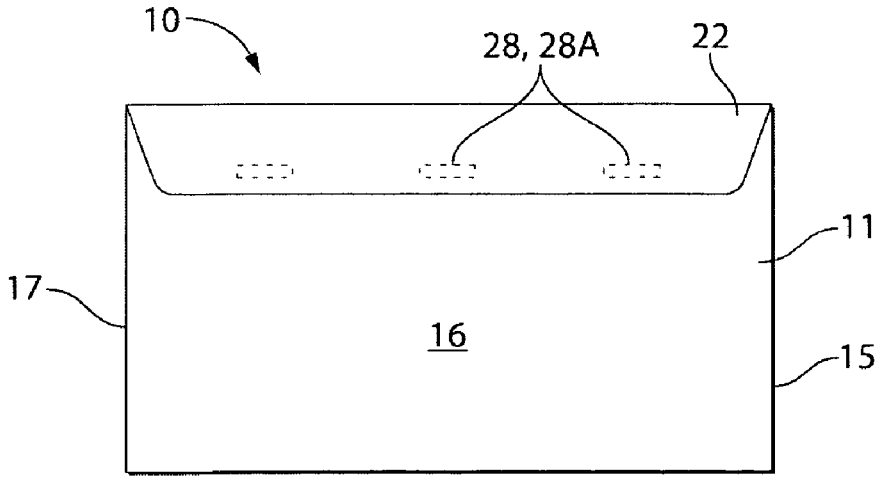

Referring to FIGS. 1D-1F, and with further reference to FIGS. 1A-1C, folding the mailer 10 is described. As shown in FIGS. 1B, 1C and 1D, the insert 12 is folded about the line of perforations 31, as shown by arrow 50 in FIGS. 1B and 1C, such that the insert 12 is folded in an upward orientation relative to the top 19 of mailer 10 and is disposed in facing relation to the second panel 16 along the back or second face 13. As shown in FIGS. 1D and 1E, the first panel 14 is folded along the first fold line or line of perforations 18 between the first and second panels 14 and 16, as shown by arrow 54 in FIG. 1D, such that the first panel 14 is folded in a downward orientation relative to the top 19 of the mailer 10 and is disposed in facing relation to the second panel 16 along the back or second face 13 and in facing relation to the insert 12 along the front or first face 11 of the mailer 10 to thereby produce a C-fold configuration, as shown in FIG. 1E. FIGS. 1E and 1F illustrate the tab closure 22 disposed along the top 19 of the mailer 10 is folded along a second fold line 18A in a downward orientation relative to the top 19 of the mailer 10, as shown by arrow 56 in FIG. 1E. At least a portion of first horizontal lines of cohesive 28 disposed on the tab closure 22 along the back or second face 13 mate with and bond to at least a portion of second horizontal lines of cohesive 28A disposed on the second panel 16 along the front or first face 13 to secure the tab closure 22 to the body of the mailer 10. Similar to the vertical lines of cohesive 24 and 26, horizontal lines of cohesive 28 and 28A may include one or more lines, dots, or other shapes or configurations of cohesive that are disposed either in a linear pattern or alternate relative to the top 19 of the mailer 10.

Figure 1G:
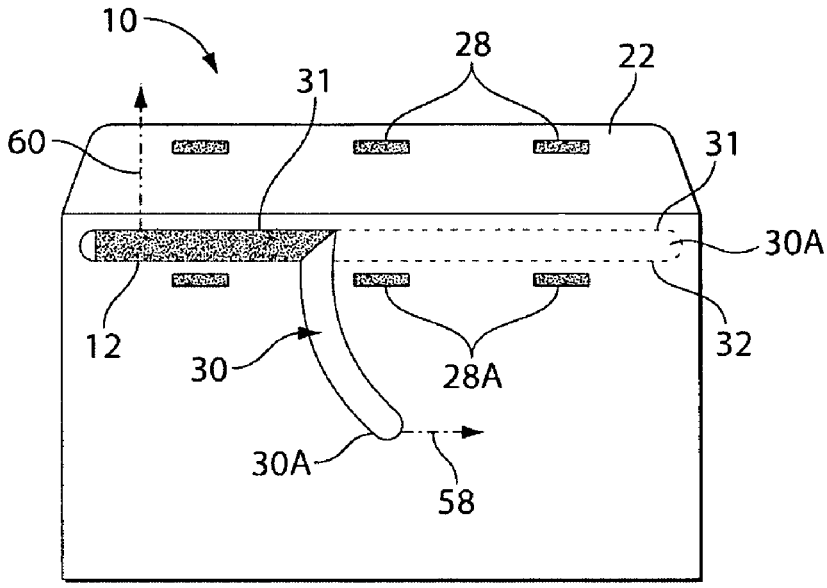
Figure 1H:
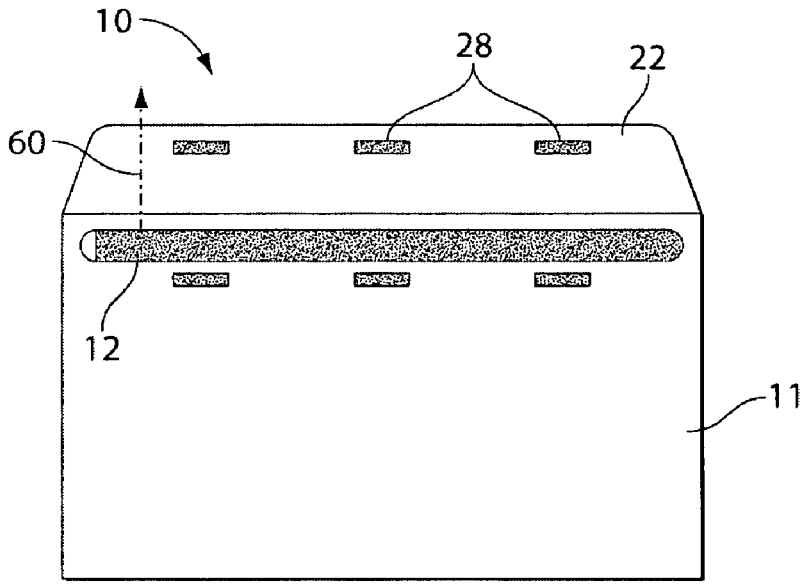

Referring to FIGS. 1G and 1H, opening the folded mailer 10 with the pull tab 30 is illustrated. To open the folded mailer 10, the tab closure 22 is removed from the front or first face 11 of the second panel 16 by separating the horizontal lines of cohesive 28 and 28A. Separation of the tab closure 22 from the second panel 16 exposes the pull tab 30. A terminal flap 30A of the pull tab 30 is configured along one end of the pull tab 30 to permit manual grasping and pulling of the pull tab 30. The terminal flap 30A may be any shape or configuration and may be defined via the lines of perforations 31 and 32, or may be die cut in the mailer 10, to facilitate lifting the terminal flap 30A from the mailer 10. To open the mailer 10, the terminal flap 30A is lifted or otherwise separated from the mailer 10 and is manually grasped and pulled in one direction, e.g., from a left side to a right side of the mailer 10, as shown by arrow 58 in FIG. 1G, along the lines of perforations 31 and 32 to a second terminal flap 30B of the pull tab 30 to thereby remove the pull tab 30 from the mailer 10. The second terminal flap 30B is defined via the lines of perforations 31 and 32, or may be die cut in the mailer 10, to facilitate ease of removal. With the removal of the pull tab 30 along the line of perforations 31 between the insert 12 and the second panel 16, as shown in FIGS. 1A-1C, the pull tab 30 thereby releases the insert 12 from the mailer 10 along the line of perforations 31. As the line of perforations 31 removably attaches the insert 12 to the second panel 16, the insert 12 is no longer attached to the mailer 10 and can be removed from the interior of the mailer 10 through its top 19, as shown by arrow 60 in FIGS. 1G and 1H. The side edges 15 and 17 of the mailer 10 remain securely attached by the vertical lines of cohesive 24 and 26. The pull tab 30 thereby enables extraction of the insert 12 through the top 19 of the mailer 10 without requiring removal of any tear-off stub or margin portions or strips to open or to provide an opening in the mailer 10.

The mailer 10 described above with reference to FIGS. 1A-1H, includes a mailer 10 configuration that may include other features, such as, for instance, an address window 40 formed in the first panel 14 that permits address information printed on the insert 12 along the back or second face 13 to be visible through the address window 40. The address window may include a die cut configuration in the first panel 14, or, alternatively, may include a transparentized portion of the first panel 14. In addition, the mailer 10 may be further printed on the first panel 14 along the front or first face 11 to include printing indicating metered, pre-paid or other postage requirements. The invention is not limited in this respect and envisions the mailer 10 shown and described with reference to FIGS. 1A-1H may serve a variety of applications and may include other features required or desired in accordance with the mailer application. For instance, as shown in FIG. 1C, the mailer 10 may not include an address window and may incorporate the insert 12 comprised of two or more panels 12A and 12B. In other instances, the mailer shown in FIGS. 1A-1H may include mailers configured to provide certain communications including, but not limited to, invoices, notices, grade reports and direct mail pieces that are configured as a single or multi-panel insert 12.

Figure 2A:
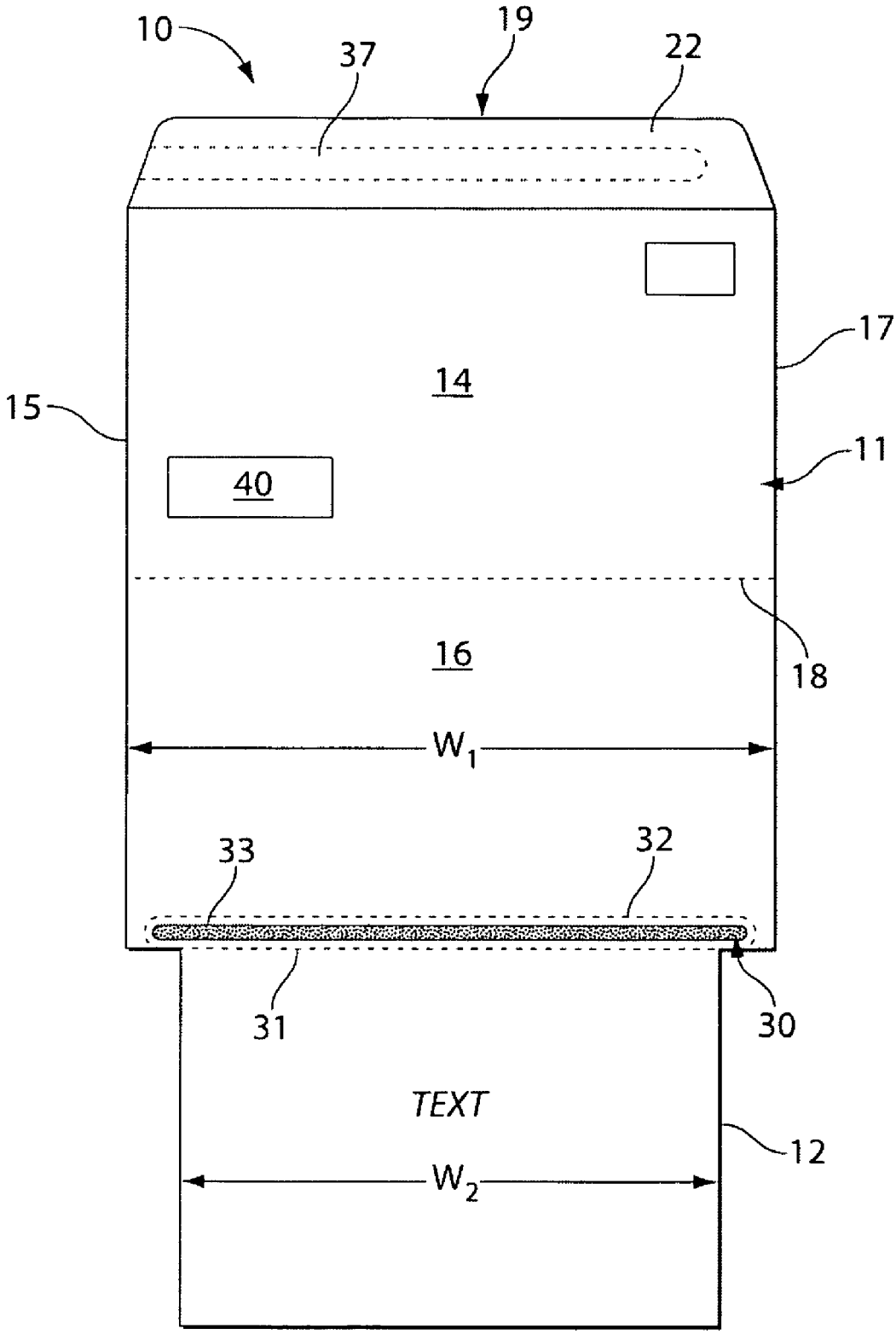
FIGS. 2A and 2B illustrate views of an alternative configuration of the mailer shown in FIGS. 1A-1C with a pull tab along a tab closure and cohesive disposed along a pull tab of an insert.
Figure 2B:
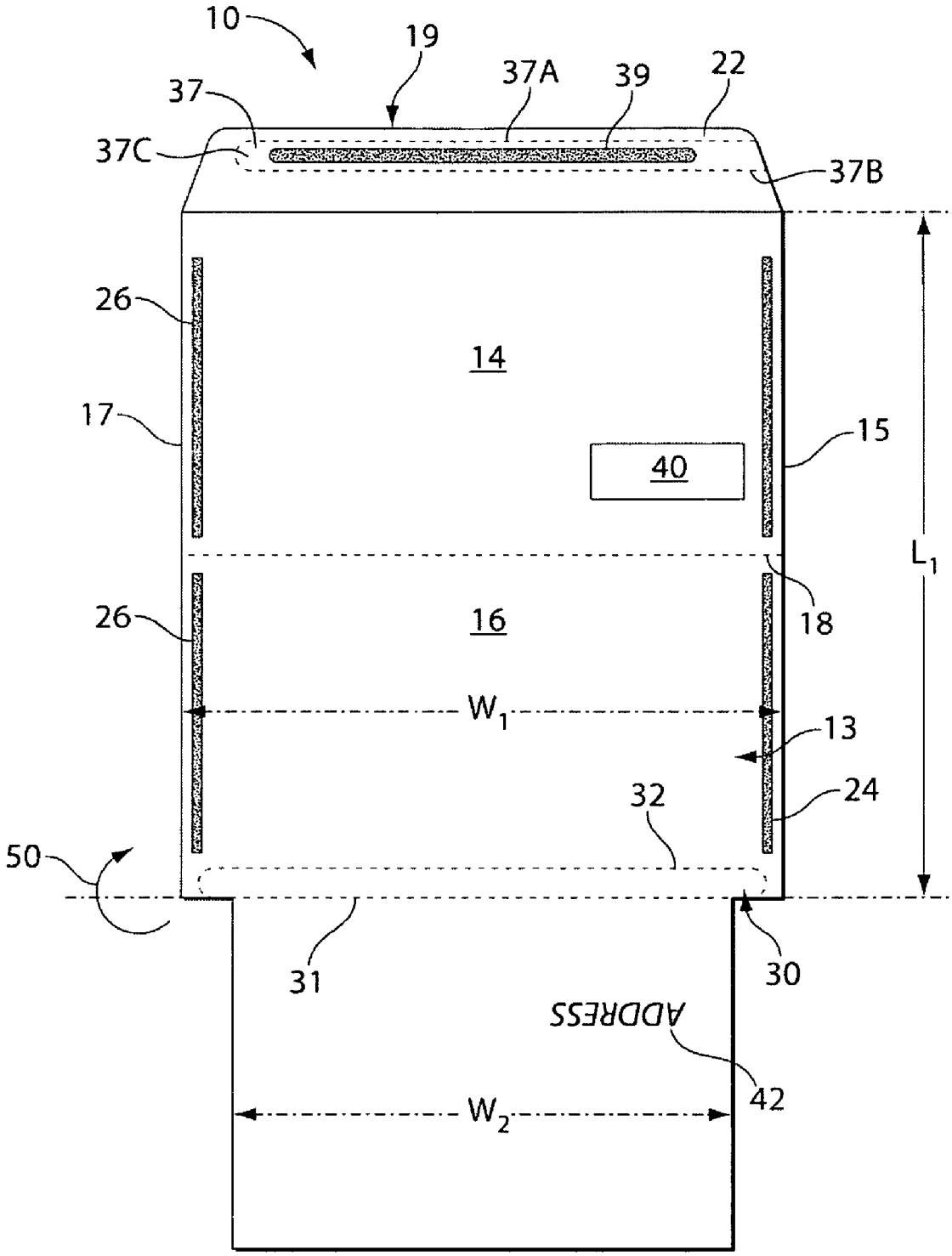

Referring to FIGS. 2A-2B, the mailer 10 can be configured as described above with reference to FIGS. 1A-1H and can alternatively include the pull tab 30 configured with an application of cohesive 33. For instance, a line of cohesive 33 is disposed between the lines of perforations 31 and 32 that define the pull tab 30 in the single ply of the mailer 10. In this configuration, the tab closure 22 can alternatively include a single removable pull tab 37 that is defined by lines, e.g., substantially parallel lines, of suitable perforations 37A and 37B that terminate into a terminal flap 37C. In this configuration, the cohesive 28 and 28A as described above are not required. The terminal flap 37C is configured, e.g., defined by a line of suitable perforations or die cut in the single ply mailer 10, to permit the flap 37C to be lifted or otherwise separated from the mailer 10 during opening of the mailer 10 with the pull tab 37. In addition, as will be described below, the pull tab 37 and the terminal flap 37C may be configured such that an edge of the terminal flap 37C is adjacent to or flush with one of the side edges 15 and 17 of the mailer 10, which is advantageous and desirable where the mailer 10 is mailed as an individual mailer 10 through the postal service. Being adjacent to or flush with a side edge 15 and 17, the terminal flap 37C is disposed to help to reduce the risk of the terminal flap 37C catching, tearing and/or causing removal of the pull tab 37 by mail or other equipment during processing and mailing of the mailer 10.

Figure 2C:
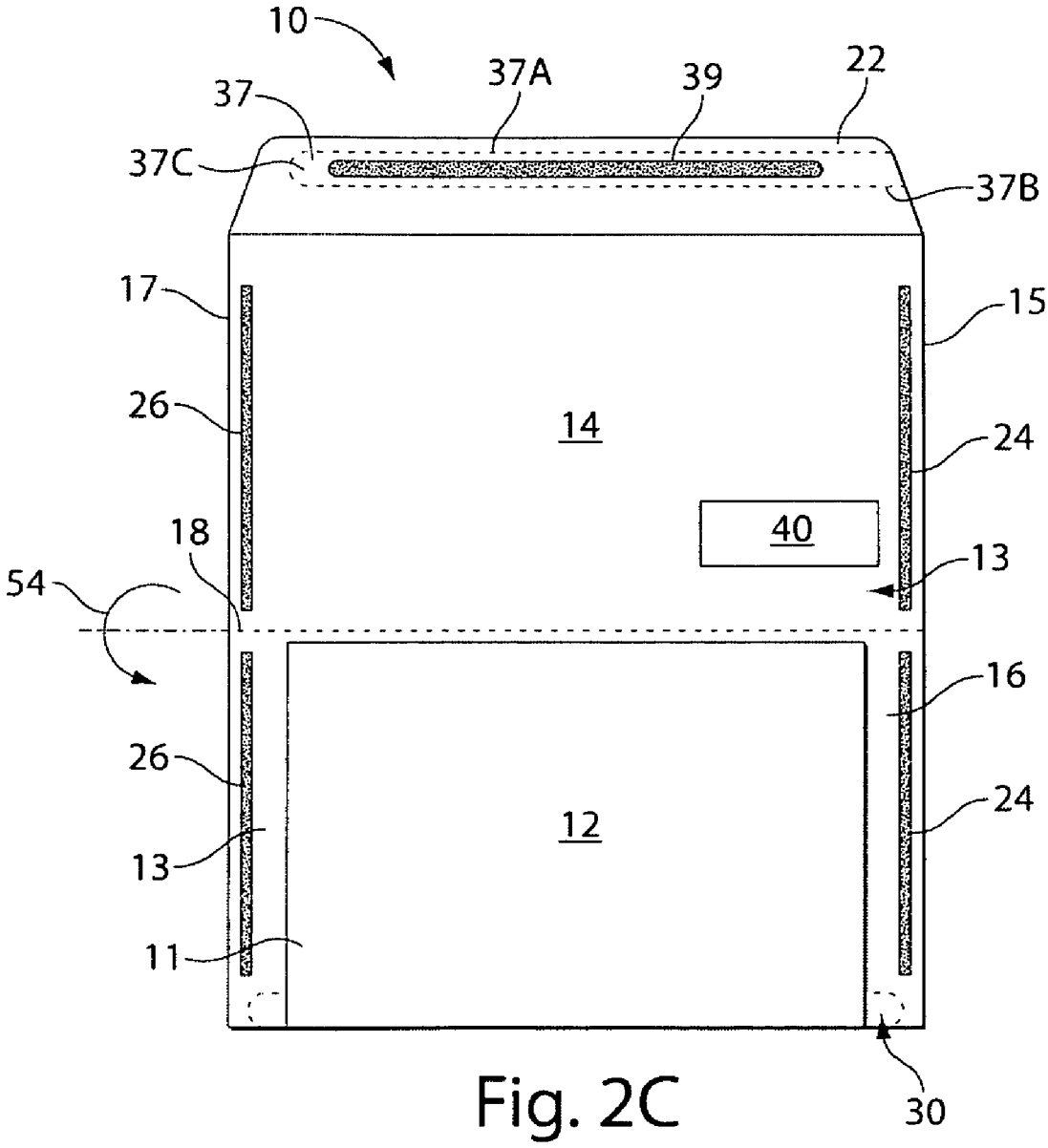
FIGS. 2C-2E illustrate views of the mailer shown in FIGS. 2A and 2B at different phases of folding.
Figure 2D:
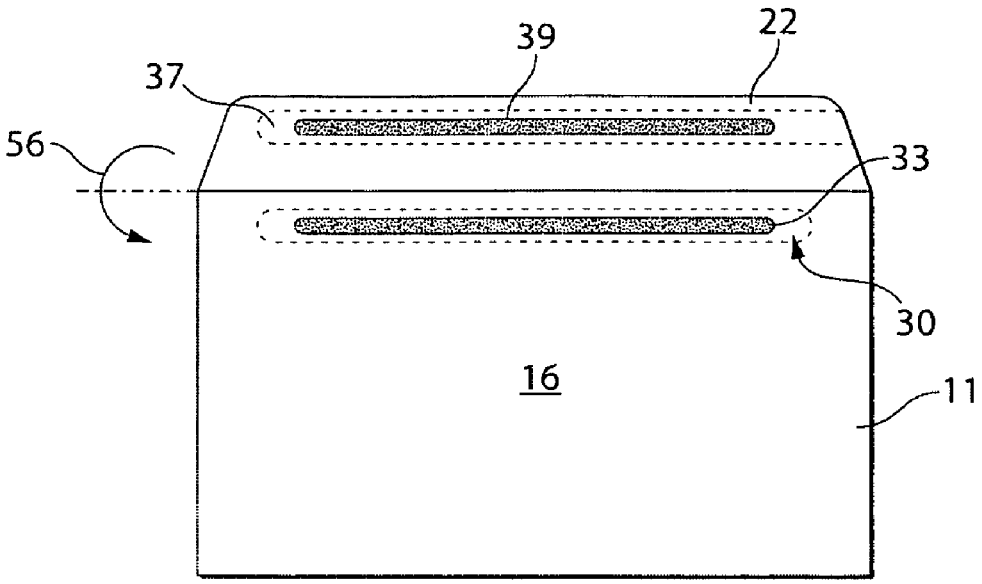
Figure 2E:
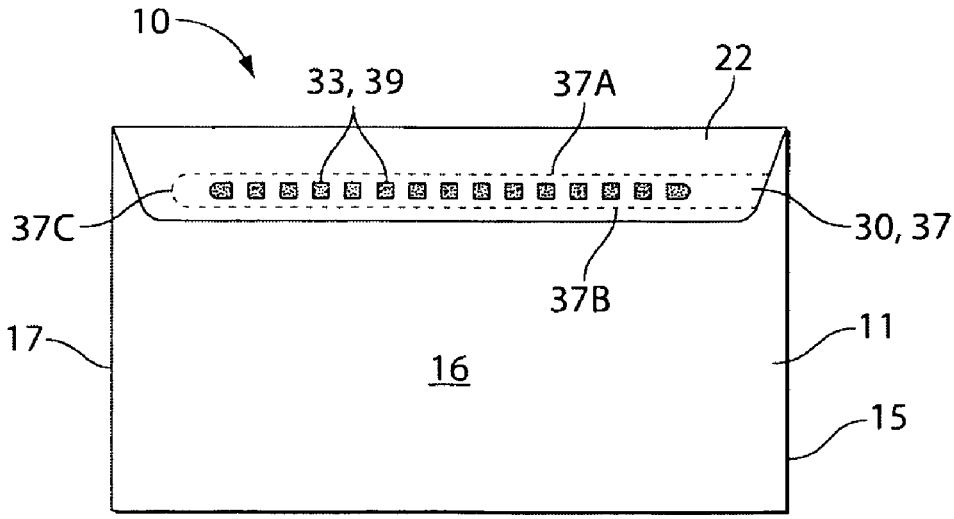

Referring to FIGS. 2C-2E, and with further reference to FIGS. 2A and 2B, folding and opening the mailer 10 are described. The insert 12 is folded as described above about the line of perforations 31, as shown by arrow 50 in FIG. 2B, such that the insert 12 is folded in an upward orientation relative to the top 19 of the mailer 10 and is disposed in facing relation to the second panel 16 along the back or send face 13. The first panel 14 is folded as described above, and as shown by arrow 54 in FIG. 2C, such that the first panel 14 is disposed in facing relation to the second panel 16 along the back or second face 13 and in facing relation to the insert 12 along the front or first face 11 of the mailer 10 to thereby produce a C-fold configuration, as shown in FIG. 2D. The tab closure 22 is folded about the second fold line 18A to fold the tab closure 22 toward and in facing relation to the pull tab 30. At least a portion of the pull tab 37 of the tab closure 22 and at least a portion of the pull tab 30 along the insert 12 substantially align such that at least a portion of the cohesive 37 along the tab closure 22 aligns with and mates to at least a portion of the cohesive 33 along the pull tab 30 to bond the pull tabs 30 and 37 together. Removing the pull tab 37, e.g., by manually grasping and pulling the terminal flap 37C, along the lines of perforations 37A and 37B causes the pull tab 37 to separate from the mailer 10 and to remove the pull tab 30 of the insert 12 along the lines of perforations 31 and 32. The pull tab 37 thereby simultaneously removes the pull tab 30 from the insert 12 and releases the one or more inserts 12 contained within the interior of the mailer 10.

Figure 3A:
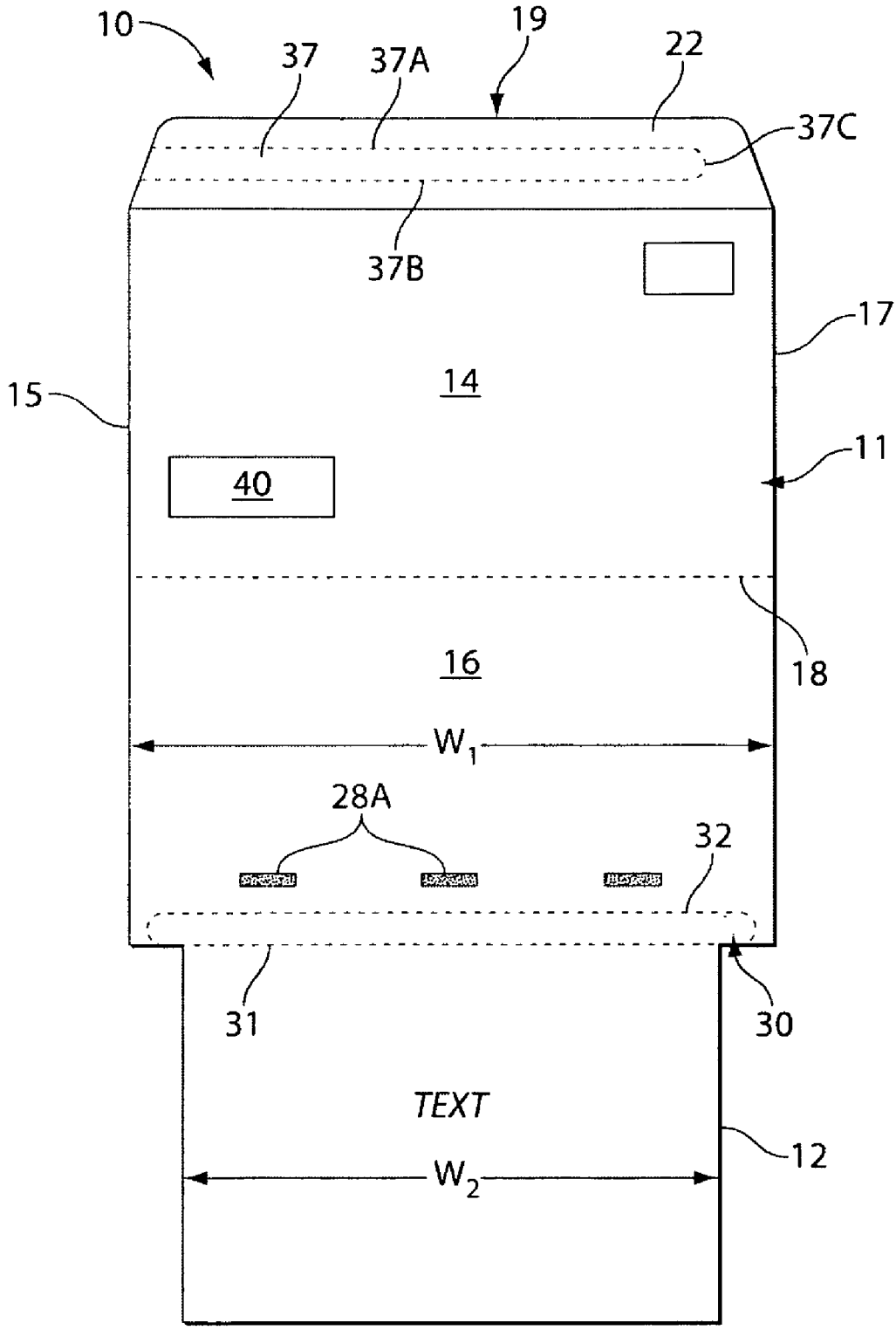
FIGS. 3A and 3B illustrate views of an alternative configuration of the mailer shown in FIGS. 1A-1C with a pull tab along a tab closure.
Figure 3B:
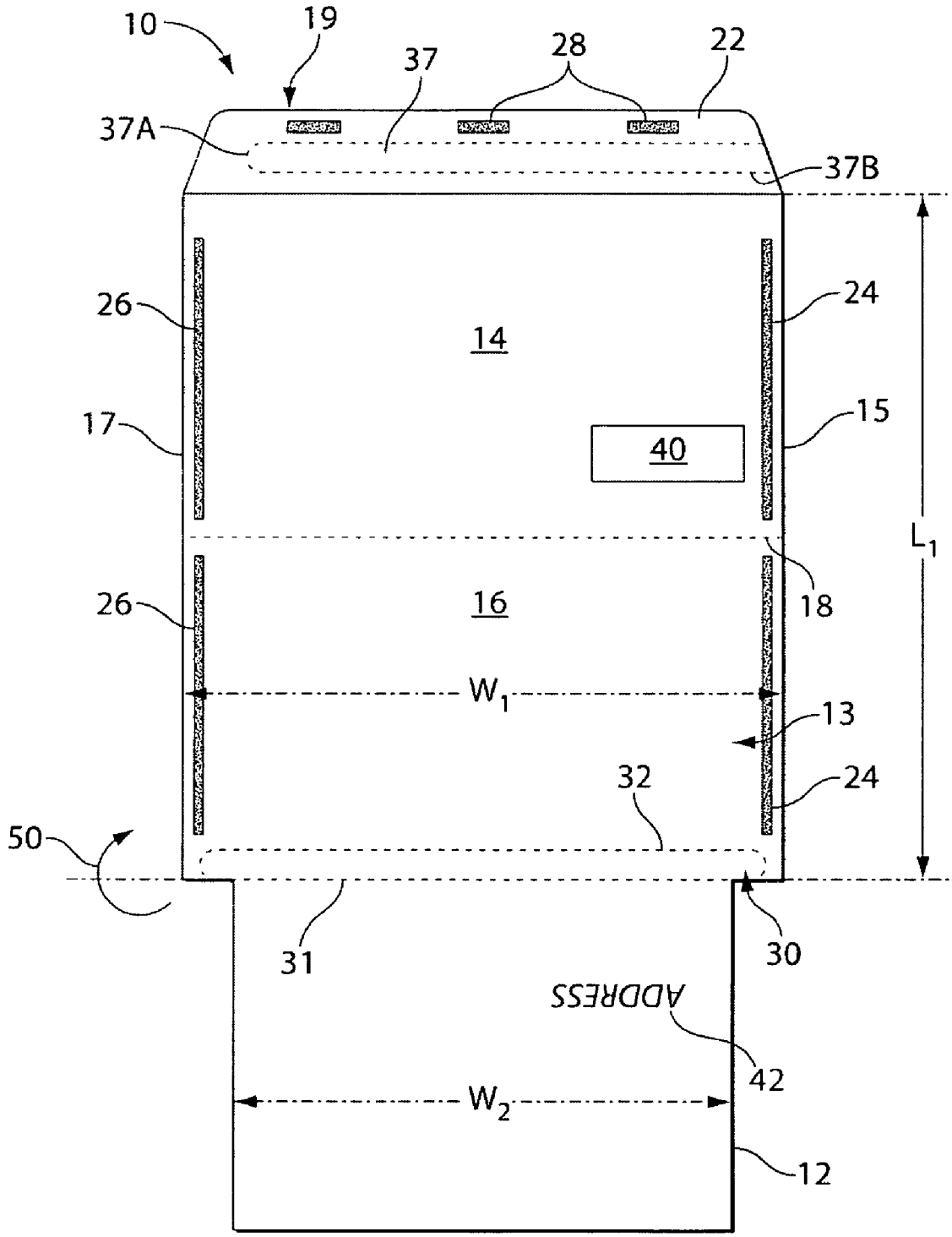

Referring to FIGS. 3A-3B, the mailer 10 can be configured as described above with reference to FIGS. 1A-1H and can further include the removable pull tab 37 along the tab closure 22 that is defined by the lines, e.g., substantially parallel lines, of perforations 37A and 37B that terminate into the terminal flap 37C, as described above with reference to FIGS. 2A and 2B. The pull tab 37 in this configuration does not include the cohesive 39, as shown in FIG. 2B, but includes the cohesive 28 and 28A as shown in FIGS. 1A and 1B to facilitate closure of the mailer 10. The pull tab 37 along the tab closure 22 is disposed and configured for at least partial alignment with the pull tab 30 along the insert 12 and is further disposed and configured for removal along the lines of perforations 37A and 37B.

Figure 3C:
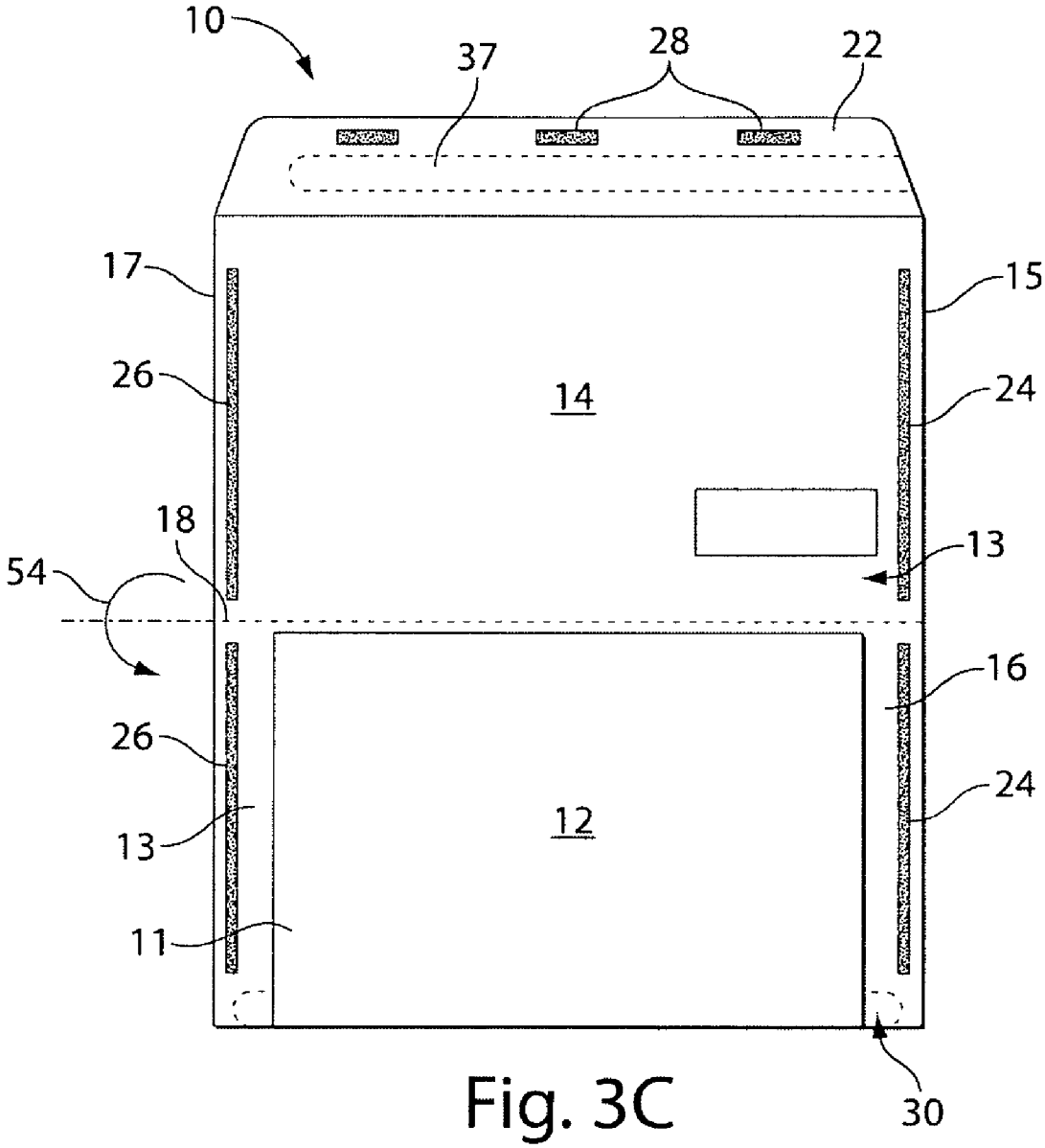
FIGS. 3C-3E illustrate views of the mailer shown in FIGS. 3A and 3B at different phases of folding.
Figure 3D:
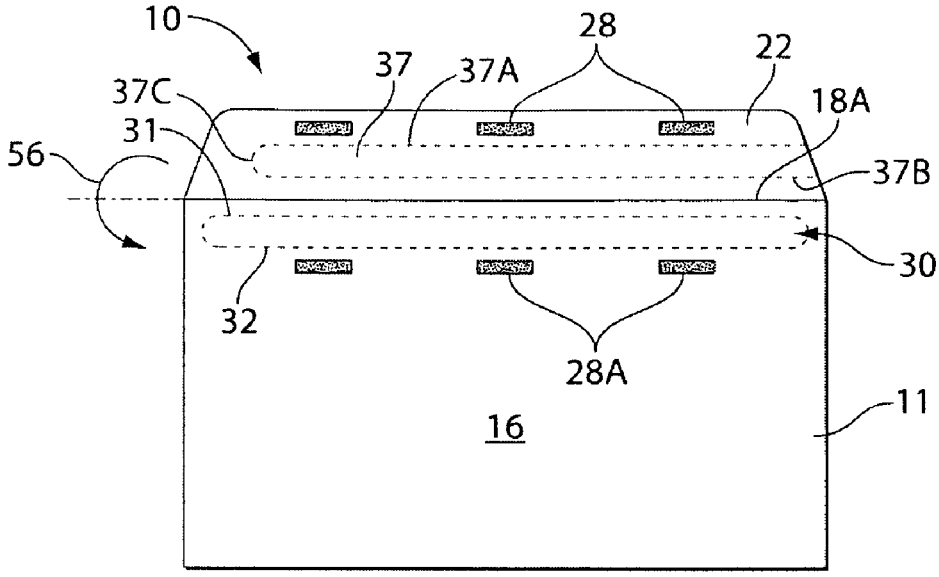
Figure 3E:
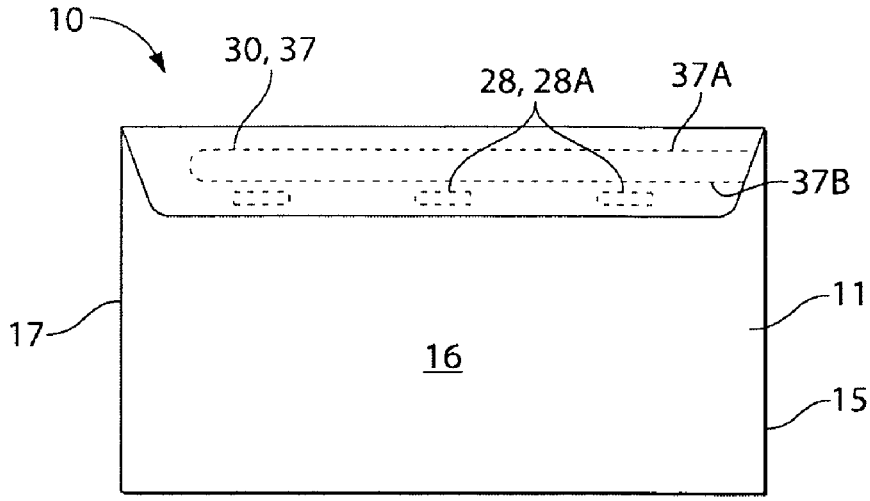

Referring to FIGS. 3C-3E, folding and opening of the mailer 10 are described. The insert 12 is folded as described above about the line of perforations 31, as shown by arrow 50 in FIG. 3B, such that the insert 12 is folded in an upward orientation relative to the top 19 of the mailer 10 and is disposed in facing relation to the second panel 16 along the back or send face 13. The first panel 14 is folded as described above, and as shown by arrow 54 in FIG. 3C, such that the first panel 14 is disposed in facing relation to the second panel 16 along the back or second face 13 and in facing relation to the insert 12 along the front or first face 11 of the mailer 10 to thereby produce a C-fold configuration, as shown in FIG. 3D. The tab closure 22 is folded about the second fold line 18A to fold the tab closure 22 toward and in facing relation to the pull tab 30. Where the terminal flap 37C is lifted or otherwise separated from the mailer 10 and is manually grasped and pulled in one direction, the pull tab 37 is removed from the mailer 10 and the pull tab 30 of the insert 12 is simultaneously exposed. The pull tab 30 may then be removed from the insert 12 without opening the tab closure 22 along the cohesive 28 and 28A and by grasping and pulling the pull tab 30 along the lines of perforations 31 and 32. In this configuration, the mailer 10 does not include cohesive along the pull tabs 30 and 37, but, rather, is configured with dual pull tabs, including the pull tab 37 to open the mailer 10 and the pull tab 30 to release the one or more inserts 12 from the interior of the mailer 10.

Figure 4:
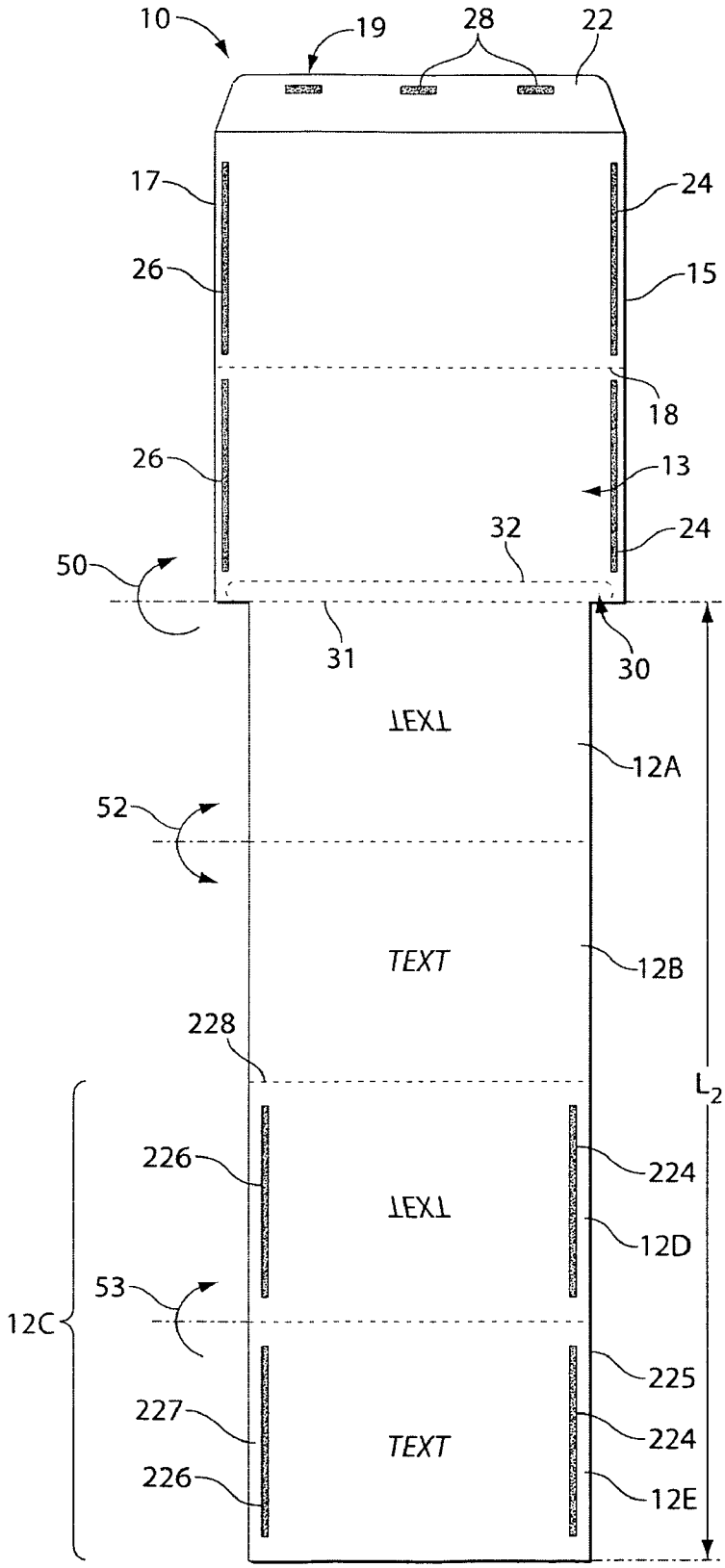
FIG. 4 illustrates a view of the mailer shown in FIGS. 1A-1H including a return envelope and insert.

Referring to FIG. 4, the mailer 10, as described with reference to FIGS. 1A-1H, 2A-2E, and 3A-3E may include a multi-panel insert 12 as described with reference to FIG. 1C and may be further configured such that two or more panels 12D and 12E of the insert 12 define a return envelope 12C comprising a first panel 12D and a second panel 12E. In this configuration, at least the first and the second panels 12D and 12E include vertical lines of cohesive 224 and 226 that extend longitudinally along the length $L_2$ of the insert 12 and proximate or adjacent to side edges 225 and 227 of the insert 12. One or more vertical lines of cohesive 224 and 226 along the first panel 12D are disposed such that when the first panel 12D is folded toward and in facing relation to the second panel 12E, as shown by arrow 53 in FIG. 4, at least a portion of the cohesive 224 and 226 along the first panel 12D mates with and bonds to at least a portion of the vertical lines of cohesive 224 and 226 along the second panel 12E to thereby form the return envelope 12C when the mailer 10 is folded. In addition, the insert 12 may define a line of suitable perforations 228 between the panels 12D and 12E defining the return envelope 12C to remove the return envelope 12C from the one or more other panels 12A and 12B of the insert 12.

Figure 5:
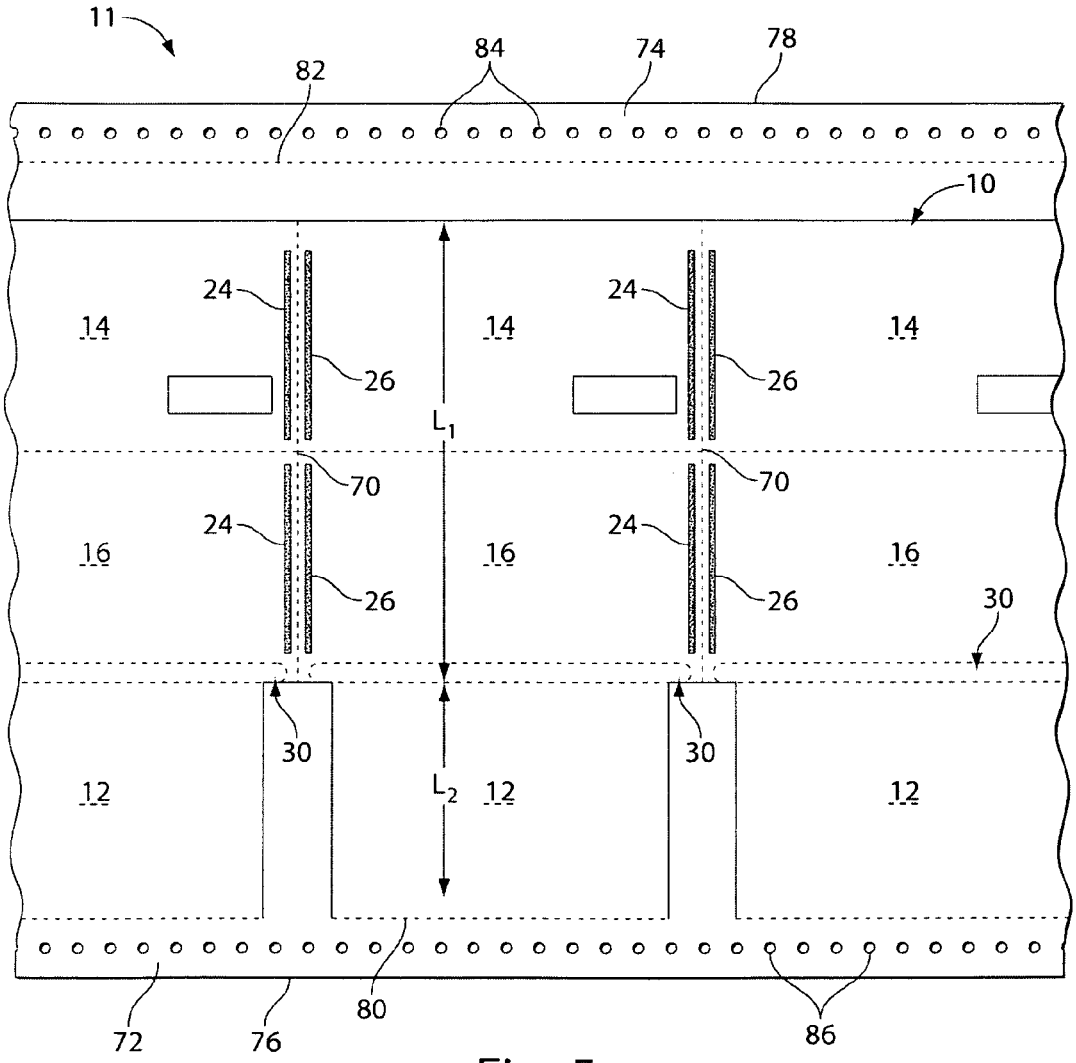
FIG. 5 illustrates a view of the mailer shown in FIGS. 1A-4 as one of multiple mailers defined in a single ply continuous web.

Referring to FIG. 5, the mailer 10 may be produced from a single sheet of paper, as shown in FIGS. 1A-1H, 2A-2E, 3A-3E, and FIG. 4, or may be produced from a continuous web of paper substrate 11 whereby one mailer 10 is attached to an adjacent mailer 10 via an optional line of suitable perforations 70 defined between the first and second sides 15 and 17 of the adjacent mailers 10. Adjacent mailers 10 are separated along the line of perforations 70 during processing of the web 11 to produce the individual mailers 10 described above. In addition, the continuous web 11 may include at least one stub or margin portion 72 and 74 defined between an edge 76 and 78 of the web 11 and a line of suitable perforations 80 and 82 that are disposed parallel and adjacent to the edge 76 and 78 of the web 11. A linear pattern of multiple sprocket holes 84 and 86 is defined along at least one stub or margin portion 72 and 74, respectively, where each hole 84 and 86 is disposed and configured to receive at least a portion of a sprocket that helps to facilitate feeding and processing of the web 11 through various equipment and systems.

Figure 6:
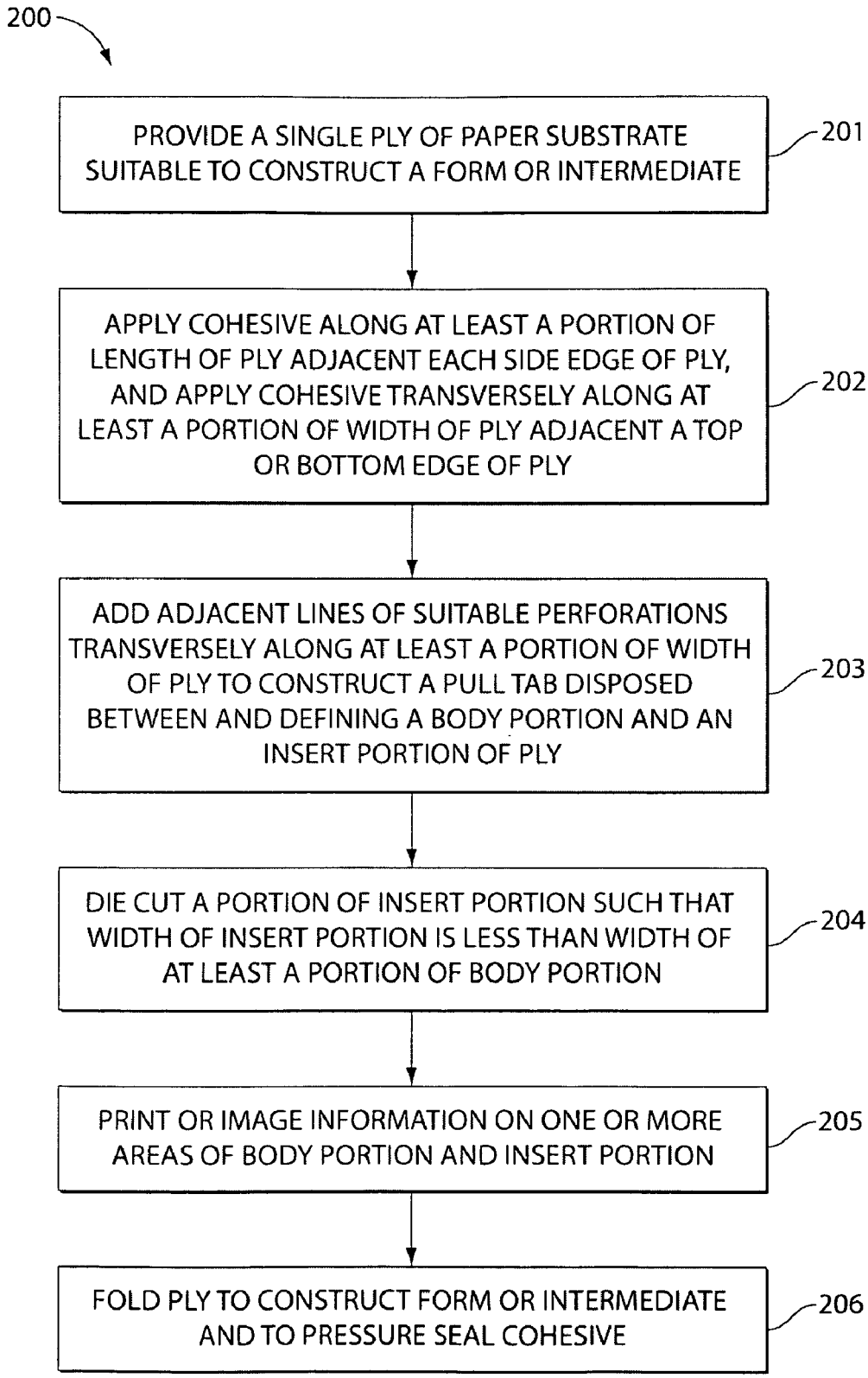
FIG. 6 is a block diagram of a method of forming the mailer shown in FIGS. 1A-4, and the mailer shown in FIGS. 8A-10C.

Referring to FIG. 6, and with further reference to FIGS. 1A-1H, 2A-2E, and 3A-3E, a block diagram illustrates a method 200 of forming the mailer 10, as well as mailer 100 described below with reference to FIGS. 8A-14B, with the pull tab 30 and may include the stages shown. The method 200, however, is exemplary only and is not limiting. The method 200 can be altered, e.g., by having stages added, removed or rearranged.

At stage 201, a single ply of paper substrate suitable for constructing a business form or business form intermediate having the first or front face 11 and the second or back face 13 is provided in the form of a single sheet to form an individual mailer 10, as shown in FIGS. 1A-3E, or is provided in the form of a continuous web 11, as shown in FIG. 5, to produce multiple mailers 10 whereby adjacent mailers 10 are connected to one another via the optional line of perforations 70 disposed between the side 15 and 17 of one mailer 10 and the side 15 and 17 of another adjacent mailer 10.

At stage 202, the mailer 10 or the web 11 of adjacent mailers 10 is processed through one or more pressure seal cohesive applicators or other devices known in the art that are adapted to apply pressure seal cohesive to the mailer 10 or to the adjacent mailers 10 of the web 11. Pressure seal cohesive 24 and 26 is applied along at least a portion of the length $L_1$ of the first and second panels 14 and 16 of the mailer 10 adjacent or proximate to the side edges 15 and 17. Pressure seal cohesive 28 and 28A is applied transversely across at least a portion of the width $W_1$ of the mailer 10 on at least a portion of the tab enclosure 22 along the back or second face 13, as shown in FIGS. 1B and 3B, and on at least a portion the second panel 16 along the front or first face 11, as shown in FIGS. 1A and 3A. Alternatively, pressure seal cohesive 33 and 39 is applied transversely across at least a portion of the width $W_1$ of the second panel 16 along the front or first face 11 adjacent to the insert 12, as shown in FIG. 2A, and on at least a portion the tab closure 22 along the back or second face 13, as shown in FIG. 2B. Cohesive 24, 26 and 28, 28A is applied such that when the mailer 10 is folded, as described above, at least a portion of the cohesive 24, 26 along the panels 14 and 16 mate with one another, and at least a portion of the cohesive 28, 28A mate with one another, to bond the mailer 10. Optionally, wherein cohesive 33 and 39 is applied and cohesive 28 and 28A is not applied such that, when the mailer 10 is folded as described above, at least a portion of the cohesive 33 aligns and mates with at least a portion of the cohesive 39. One or more cohesive(s) 24, 26, 28, 28A, 33 and 39 that are applied to the mailer 10 are laser safe in order that one or more cohesive(s) 24, 26, 28, 28A, 33 and 39 may be pre-applied to the single sheet mailer 10 or to the adjacent mailers 10 of the web 11 before the mailer 10 or web 11 is printed by any of a variety of laser or other types of printers known in the art.

At stage 203, the mailer 10 or the adjacent mailers 10 of the web 11 is/are processed through one or more die cutting machines or other devices known in the art adapted to add the lines of suitable perforations 31 and 32 transversely along at least a portion of the width $W_2$ of the singly ply 10 to define the first and second panels 14 and 16 of the body portion and the one or more panels of the insert 12 and to define and dispose therebetween the insert pull tab 30, as shown, for example, in FIGS. 1A and 1B and FIGS. 2A and 2B and FIGS. 3A and 3B. Optionally, the lines of suitable perforations 37A and 37B along the tab closure 22 are added to define the pull tab 37, as shown, for example, in FIGS. 2B and 2C.

At stage 204, the mailer 10 or the adjacent mailers 10 of the web 11 is/are further processed through one or more die cutting machines or other devices known in the art adapted to die cut the insert 12 from the single ply mailer 10 or to die cut the one or more inserts 12 of the adjacent mailers 10 of the web 11 to either define the insert 12 with a single panel, as shown in FIGS. 1A and 1B or 2A and 2B or 3A and 3B, or with multiple panels 12A and 12B, as shown in FIG. 1C.

At stage 205, the die cut mailer 10 or the die cut adjacent mailers 10 of the web 11 is/are processed through any of a variety of printers known in the art including, but not limited to, roll, sheet, fanfold, impact, ink jet and laser printers, to print information on selected areas of the panels 14 and 16 and the insert 12 along the front or first face 11 and/or along the back or second face 13, depending upon the application of the mailer 10.

At stage 206, individual printed mailers 10 are separated from the continuous web 11. An individual printed mailer 10 is processed through one or more folder sealers including, but not limited to, a PS300 folder sealer from Paragon, a AS1200 folder sealer from PFE, or other folder sealer device(s) known in the art that are adapted to fold and to pressure seal applied cohesive along the mailer 10. The mailer 10 may be folded into a C-fold, Z-fold or a double parallel configuration whereby the cohesive 24 and 26 is sealed together by pressure and, optionally, either cohesive 28, 28A or 33, 39 is sealed together by pressure to thereby securely seal the mailer 10 along its side edges 15 and 17 and along the top closure 22.

Figure 7A:
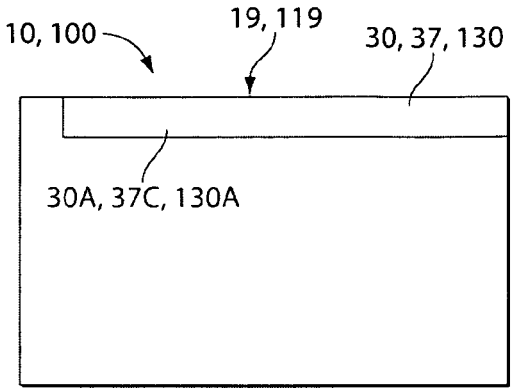
FIGS. 7A-7F illustrate views of different configurations of a pull tab for any of the mailers shown in FIGS. 1A-15B.
Figure 7B:
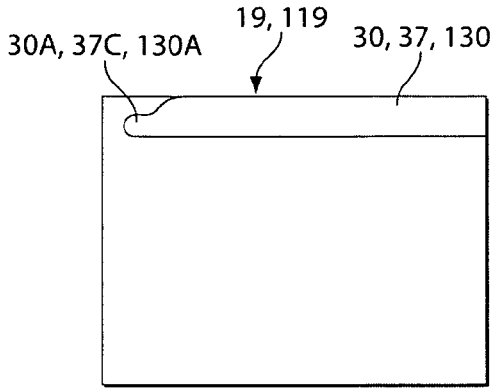
Figure 7C:
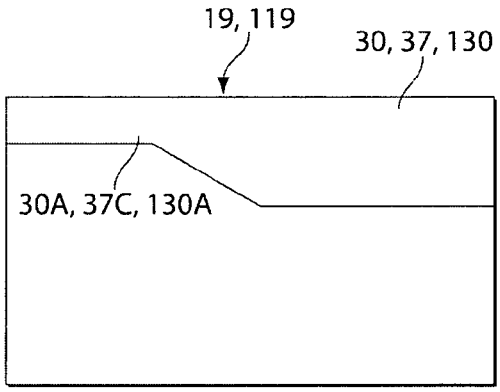
Figure 7D:
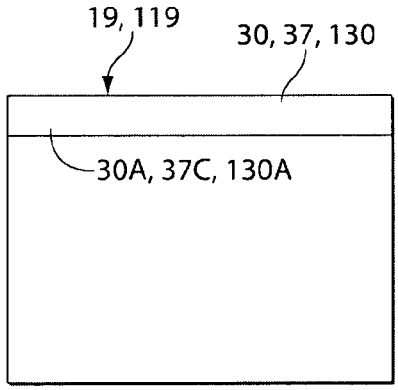
Figure 7E:
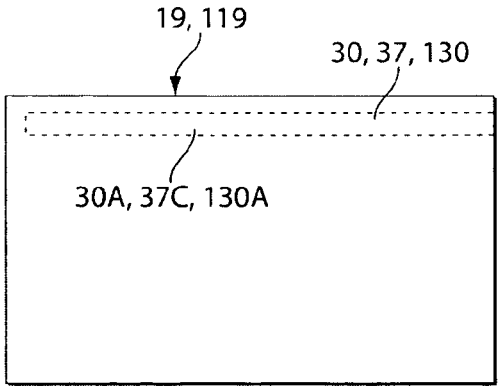
Figure 7F:
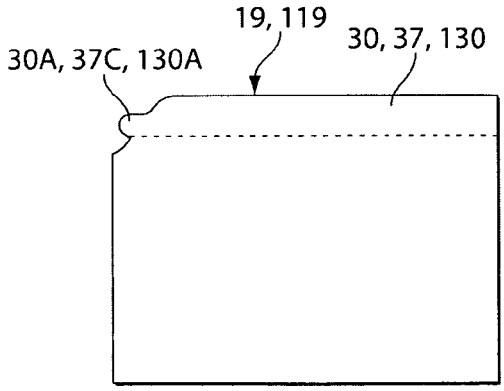

Referring to FIGS. 7A-7F, various configurations of the pull tab 30, 37, 130, as shown in and described with reference to FIGS. 1A-1H, 2A-2E, 3A-3E, 4, and 8A-15B, are illustrated. The invention however is not limited to the configurations of the pull tab 30, 37, 130 and the terminal flap 30A, 37C and 130A that are shown and described with reference to FIGS. 7A-7F and anticipates the pull tab 30, 37, 130 and the terminal flap 30A, 37C and 130A may define other configurations in addition to the configurations shown. As shown in FIGS. 7A-7D and FIG. 7F, the pull tab 30, 37 and 130 may be defined by an edge, e.g., the top edge 19 and 119, of the mailer 10 and 100 and the line of perforations 32, 37B and 132. As shown in FIG. 7E, the pull tab 30, 37 and 130 may be defined by adjacent lines of perforations 31,32 and 37A, 37B and 132, 134. In addition, the terminal flap 30A, 37C and 130A may have various configurations. For instance, as shown in FIGS. 7A, 7B and 7E, the terminal flap 30A, 37C and 130A is configured such that the terminal flap 30A, 37C and 130A is spaced from one of the side edges 15, 17 and 115, 117 of the mailer 10 and 100. In this case, the mailer 10 and 100 may be processed through postal service equipment with a reduced risk the terminal flap 30A, 37C and 130A being torn or otherwise separated from the mailer 10 and 100 during processing. In another instance, the terminal flap 30A, 37C and 130A is proximate to or substantially flush with one of the side edges 15, 17 and 115, 117 of the mailer 10 and 100, as shown in FIGS. 7C and 7D. In a further instance, the terminal flap 30A, 37C and 130A may be die cut to extend from the mailer 10 and 100 as shown in FIG. 7F. Alternatively, the pull tab 30, 37 and 130 may be defined by adjacent lines of perforations 31, 32 and 37A, 37B and 132, 134 that are substantially parallel to one another, as shown in FIG. 7E, or, in another alternative, may be defined by the top edge 19 and 119 of the mailer 10 and 100 and the adjacent line of perforations 32, 37B and 132. In this case, the line of perforations 37, 37B and 132 may be disposed substantially parallel line to the top edge 19 and 119, as shown in FIGS. 7A, 7B, 7D and 7F, or may be disposed as a non-parallel line to the top edge 19 and 199, as shown in FIG. 7C. The pull tab 30, 37 and 130 and the terminal flap 30A, 37C and 130A, as mentioned, are defined and configured by one or more lines of perforations 31,32 and 37A, 37B and 132, 134. The invention however, is not limited in this respect and envisions the terminal flap 30A, 37C and 130A and the lines of perforations 31, 32 and 37A, 37B and 132, 134 may be defined, wholly or partially, in the mailer 10 and 100 by die cutting techniques such that the terminal flap 30A, 37C and 130A and the lines of perforations 31, 32 and 37A, 37B and 132, 134 are die cut lines of weakness.

Referring to FIGS. 8A and 8B and FIGS. 9A and 9B, in another aspect, the invention provides a mailer 100 including a single ply of any of a variety of papers suitable to form a mailer or a mailer intermediate that may be printed by various methods known in the art. The single ply mailer 100 has a front or first face 111 and a back or second face 113 that define a first panel 114 and a second panel 116. The first and the second panels 114 and 116 are further defined by a first fold line or line of perforations 118 that separates the first and second panels 14 and 16. The single ply mailer 100 further defines at least one insert 112 that extends from one of the first and second panels 14 and 16 and, as shown in FIGS. 8A-8B and 9A-9B, preferably extends from the first panel 114. The insert 112 is further defined by a line of suitable perforations 131 disposed between the first panel 114 and the insert 112.

The single ply of the mailer 100 may have any required or desired dimensions to define the mailer 10 with any of a variety of configurations, such as, for instance, a rectangular configuration, as shown in FIGS. 8A-8B and 9A-9B. The overall dimensions of the single ply mailer 100 can include, but are not limited to, overall dimensions in a range of from about 8.5 inches by about 11 inches; about 8.5 inches by about 14 inches; about 11 inches by 14 inches; about 11 inches by about 17 inches; and up to about 11 inches by about 18 inches and about 11.5 inches by about 28 inches for larger unique-sized mailers 10. The overall dimensions can depend upon any of a variety of laser printers known in the art that is used to image/print the mailer 100.

In addition, the first and second panels 114 and 116 may have similar or substantially equal dimensions, while the insert 112 has at least one dimension that is smaller or less than the counterpart dimension of the first and/or second panels 114 and 116 in order the insert 112 may fit within or between the first and second panels 114 and 116 when the mailer 100 is folded. For example, as shown in FIGS. 8A-8B and 9A-9B, the insert 112 has a width $W_3$ that is smaller or less than the width $W_4$ of either the first or the second panel 114 and 116. During folding of the mailer 100, the insert 112 is folded along the line of perforations 131, as shown by arrow 60 in FIG. 9, to dispose the insert 112 in facing relation to the back or second face 113 of the mailer 100 and within or between the first and second panels 114 and 116. The larger size of the first and/or the second panels 114 and 116 relative to the insert 112 helps to accommodate the size of the insert 112 and helps to ensure that the insert 112 is substantially contained within or between the panels 114 and 116. In addition, the size of the insert 112 relative to the mailer 100 helps the insert 112 avoid contact with pressure sensitive cohesive during application of such cohesive and folding of the mailer 100 into its final configuration.

The insert 112 is formed from the single ply of the mailer 100 by die cutting a portion of the mailer 100, e.g., a portion other than the first and second panels 114 and 116, to define the insert 112 with at least one dimension that is smaller or less than the counterpart dimension of the first and/or the second panels 114 and 116. Preferably, the insert 112 is die cut with a width $W_3$ that is smaller or less than a width $W_4$ of at least one of the first and second panels 114 and 116 to facilitate folding and containment of the insert 112 within the interior of the mailer 100 as described above.

Figure 9A:
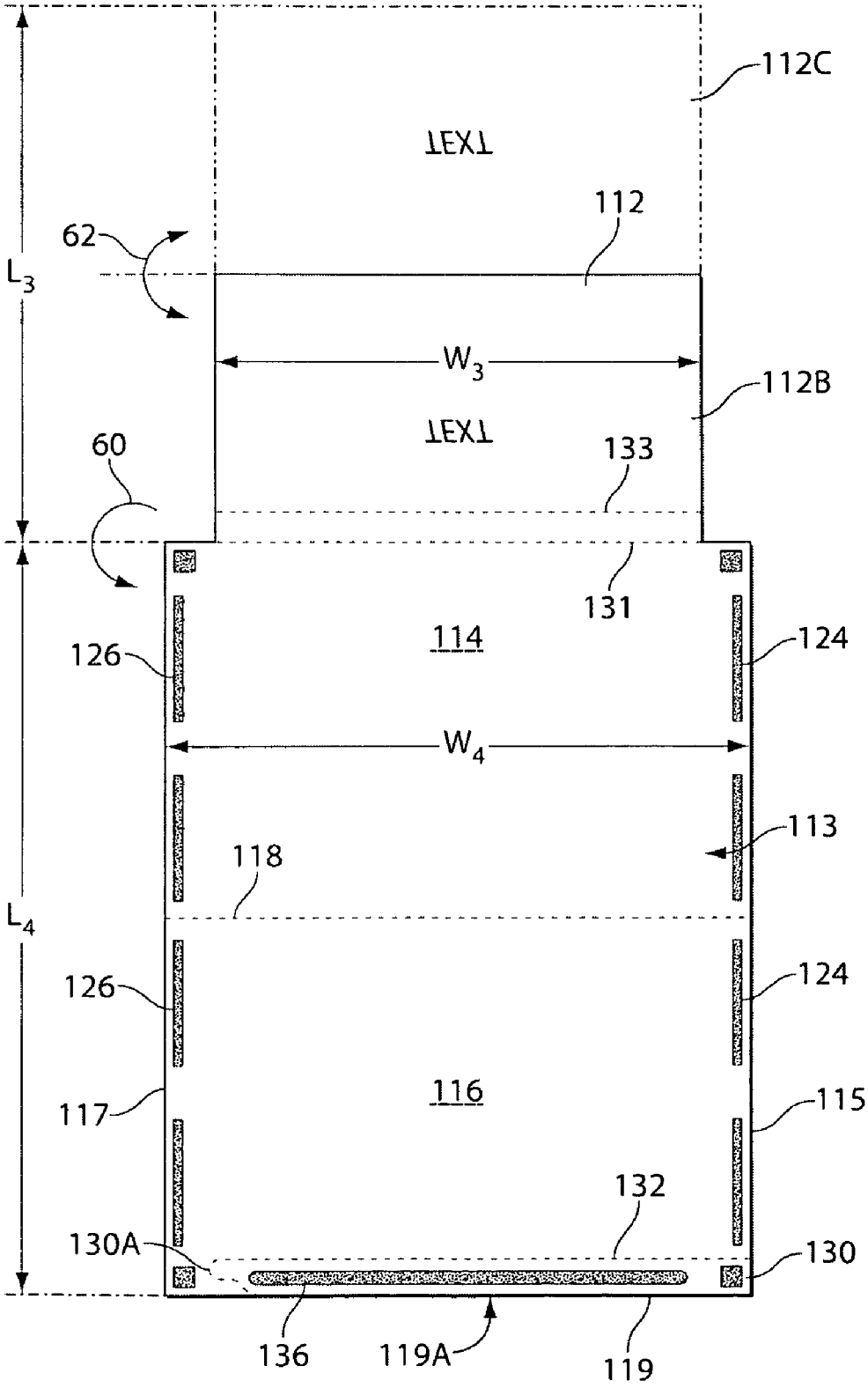
FIGS. 9A and 9B illustrate views of a back or second face of the mailer shown in FIGS. 8A and 8B.
Figure 9B:
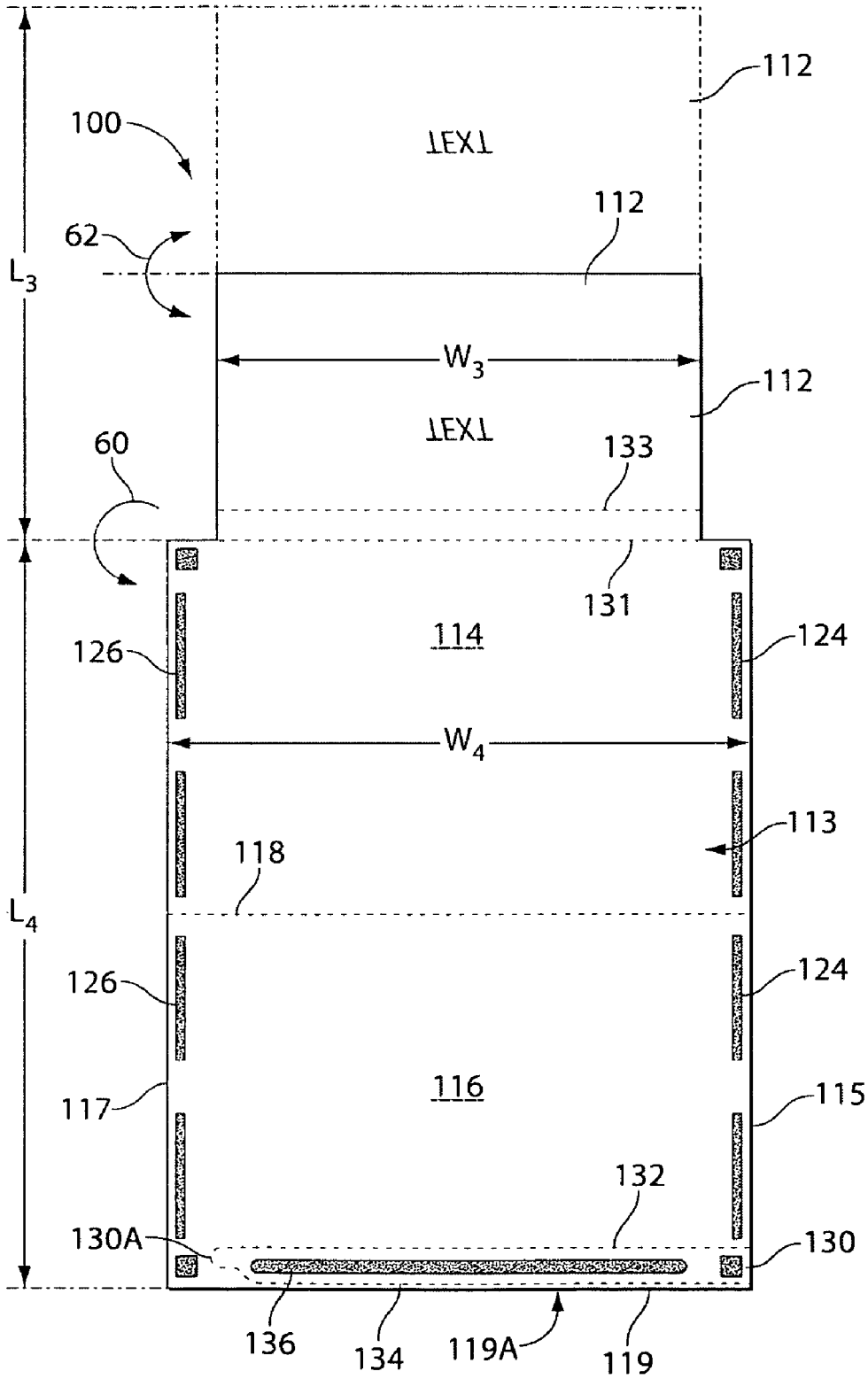

With further reference to FIGS. 9A and 9B, the insert 112 may comprise more than a single panel and may be configured with two or more equal or unequal panels 112B and 112C (shown in dashed lines). In this case, the insert 112 would be folded about each panel 112B and 112C in order to reduce the length $L_3$ of the insert 112 such that when the insert 112 is folded about the line of perforations 131, as shown by arrow 60 in FIG. 9, and into the first and second panels 114 and 116, the insert 112 is substantially contained within or between the panels 114 and 116. The panels 114 and 116 define a length $L_4$ that enables the panels 114 and 116, when folded, to contain the single or multi-ply insert 112 within the interior the folded panels 114 and 116.

As shown by arrow 62 of FIG. 9, one panel 112C may be folded in an upward orientation relative to a top 119 of the mailer 100 in facing relation to the other panel 112B of the insert 112 along the back or second side 113 of the mailer 100. Alternatively, as also shown by arrow 62 in FIG. 9, one panel 112C may be folded in an upward orientation relative to the top 119 of the mailer 10 in facing relation to the other panel 112B of the insert 112 along the front or first side 111. In each case, the insert 112 is folded along its length $L_3$ to thereby reduce the length $L_3$ of the insert 112 in order the insert 112 may be accommodated by and disposed between the first and second panels 114 and 116 as described above. Similarly, two or more panels 112B and 112C of the insert 112 may be Z-folded along the insert's 112 length $L_3$ in order to reduce the length $L_3$ of the insert 12 such that the length $L_4$ of the first and the second panels 14 and 16 accommodate the insert 12.

With further reference to FIGS. 8A-8B and 9A-9B, the mailer 100 includes one or more vertical lines of pressure sensitive cohesive 124 disposed on the back or second face 113 of the mailer 100 that extend longitudinally along the first and the second panels 114 and 116 and proximate or adjacent to a first side edge 115 of the mailer 100. Similarly, the mailer 100 includes one or more vertical lines of pressure sensitive cohesive 126 disposed on the back or second face 113 that extend longitudinally along the first and the second panels 114 and 116 and proximate or adjacent to a second side edge 117 of the mailer 100. The one or more vertical lines of cohesive 124 and 126 along the first panel 114 are disposed such that when the first panel 114 is folded about the first fold line or line of perforations 118 toward the back or second face 113 of the mailer 100, the one or more vertical lines of cohesive 124 and 126 mate with the vertical lines of cohesive 124 and 126 along the second panel 116. One or both vertical lines of cohesive 124 and 126 may alternatively include dots or other shapes or configurations of cohesive rather than lines. In addition, one or both vertical lines of cohesive 124 and 126 may include a linear pattern of cohesive 124 and 126 whereby one or more lines, dots, or other shapes or configurations of cohesive are disposed along the first and the second panels 114 and 116, as described above, in a linear and repeating pattern arrangement. Alternatively, each vertical line of cohesive 124 and 126 may define a single line of cohesive 124 and 126 extending along the first and second panels 114 and 116, or may define multiple lines of cohesive 124 and 126 that are disposed along the first and second panels 114 and 116 in alternating positions, e.g., such that one line of cohesive 124 or 126 is immediately adjacent the side edge 115 or 117, respectively, and a subsequent and adjacent line of cohesive 124 or 126 is spaced from the side edge 115 or 117, respectively. The invention is not limited in this respect and anticipates various types of arrangements or patterns of vertical lines, dots or other configurations of cohesive 124 and 126 along the first and second panels 114 and 116 such that cohesive 124 and 126 disposed along the first panel 114 mates with cohesive 124 and 126 disposed along the second panel 116 to secure the mailer 100 along its side edges 115 and 117. Depending upon the application in which the mailer 100 is to be employed, the type of pressure sensitive cohesive 124 and 126 applied to the first and second panels 114 and 116 may fixedly secure the first and second panels 114 and 116 together.

Figure 8A:
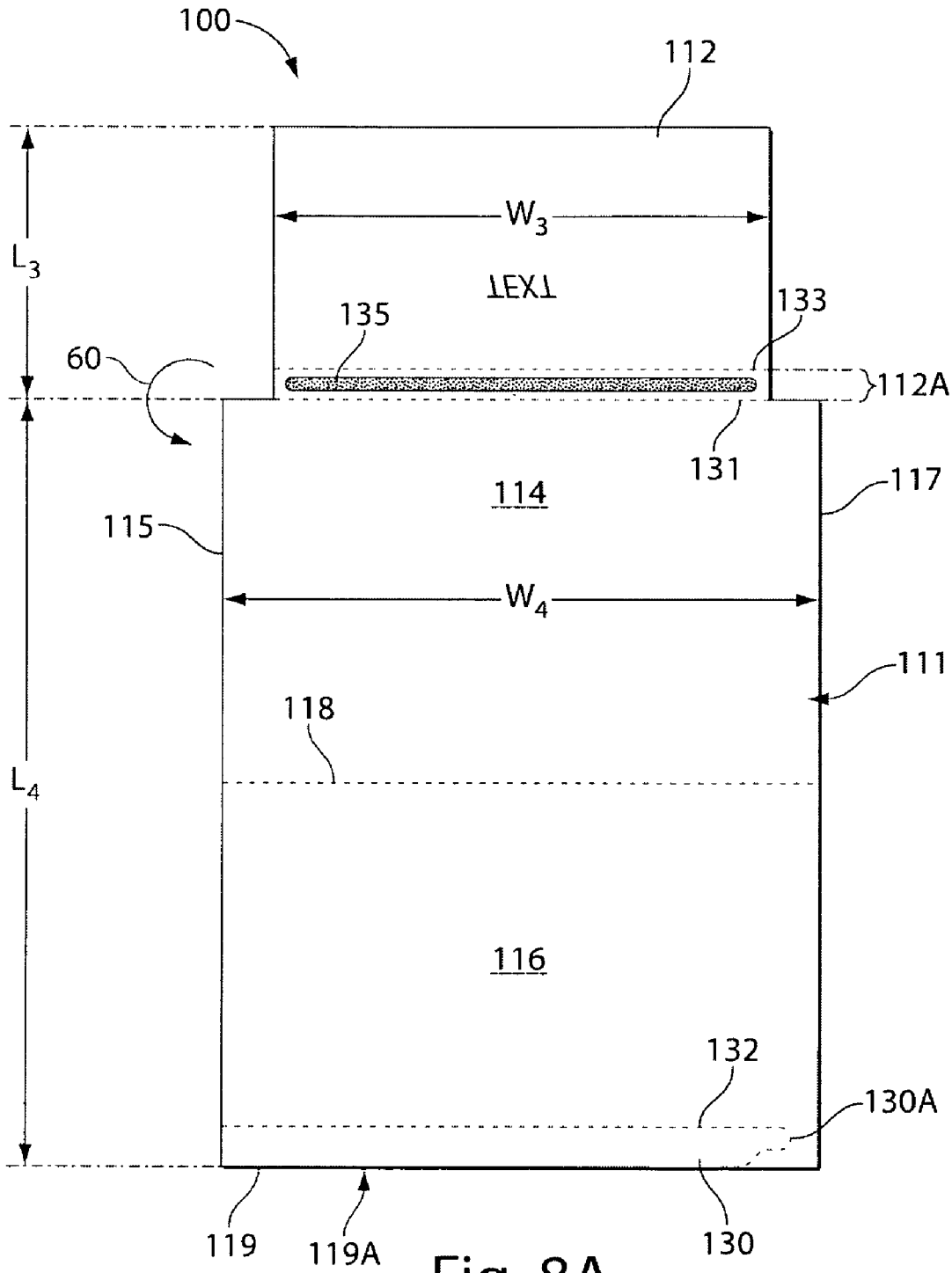
FIGS. 8A and 8B illustrate views of a front or first face of a single ply pressure seal mailer with an insert according to another aspect of the invention.
Figure 10A:
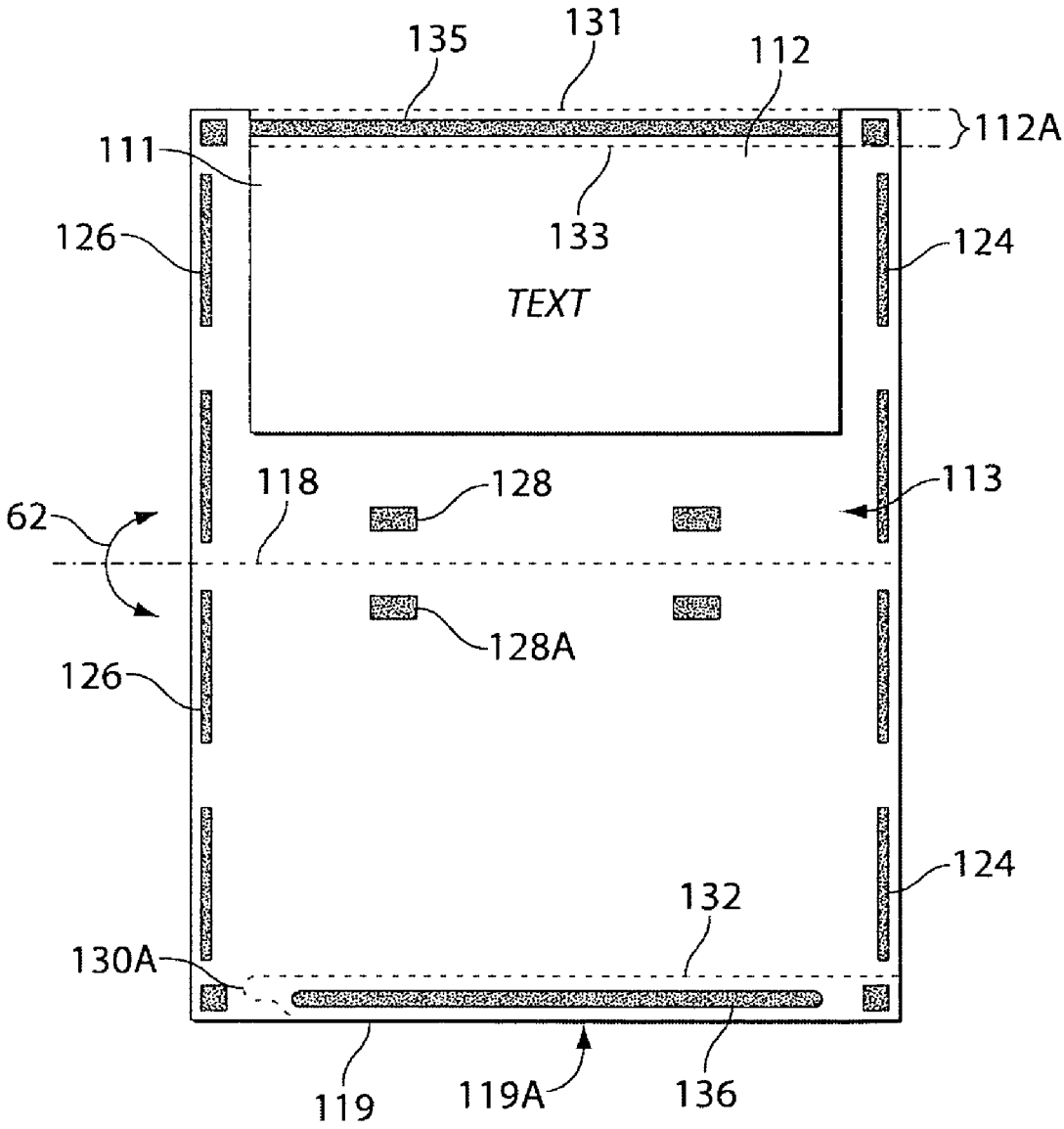
FIG. 10A illustrates a view of the mailer shown in FIGS. 8A-8B and FIGS. 9A-9B with an insert folded inwardly toward the back or second face of the mailer.

Referring to FIG. 10A, and with further referenced to FIGS. 8A-8B and 9A-9B, the mailer 100 includes a pull tab 130 defined in the mailer 100 by a line of suitable perforations 132 defined through the single ply, e.g., through the front and the back faces 111 and 113, of the mailer 100. In addition, the line of perforations 132 may define the pull tab 130 to extend beyond outer edges of the insert 112. As shown in FIGS. 8A, 9A and 10A, the pull tab 130 is defined along the top 119 of the mailer 100 proximate or immediately adjacent to a top edge 119A of the mailer 100. A horizontal line of pressure sensitive cohesive 136 is disposed on the pull tab 130 between the line of perforations 132 and the top edge 119A along the back or second face 113 of the mailer 100.

Still referring to FIG. 10A, the line of perforations 132 of the pull tab 130 is disposed such that, when the insert 112 is folded along the line of perforations 131 in an upward orientation relative to the top 119 of the mailer 100 as shown by arrow 60 in FIGS. 8A and 9A, alignment of the line of perforations 132 with a line of perforations 133 defined in the insert 112 is facilitated, while alignment of the top edge 119A of the pull tab 130 with the line of perforations 131 between the insert 112 and the first panel 114 is facilitated. The line of perforations 133 of the insert 112 is defined through the single ply, e.g., through the front and back faces 111 and 113. In addition, the horizontal line of cohesive 136 is disposed along the pull tab 130 such that, when the insert 112 is folded along the line of perforations 131 as described, alignment and mating of the line of cohesive 136 with a horizontal line of cohesive 135 disposed on the insert 112 between the lines of perforations 131 and 133 along the front or first face 111 is facilitated. The lines of perforations 131 and 133 of the insert 112 define an insert pull tab 112A that includes the horizontal line of cohesive 135 between the lines of perforations 131 and 133.

Figure 8B:
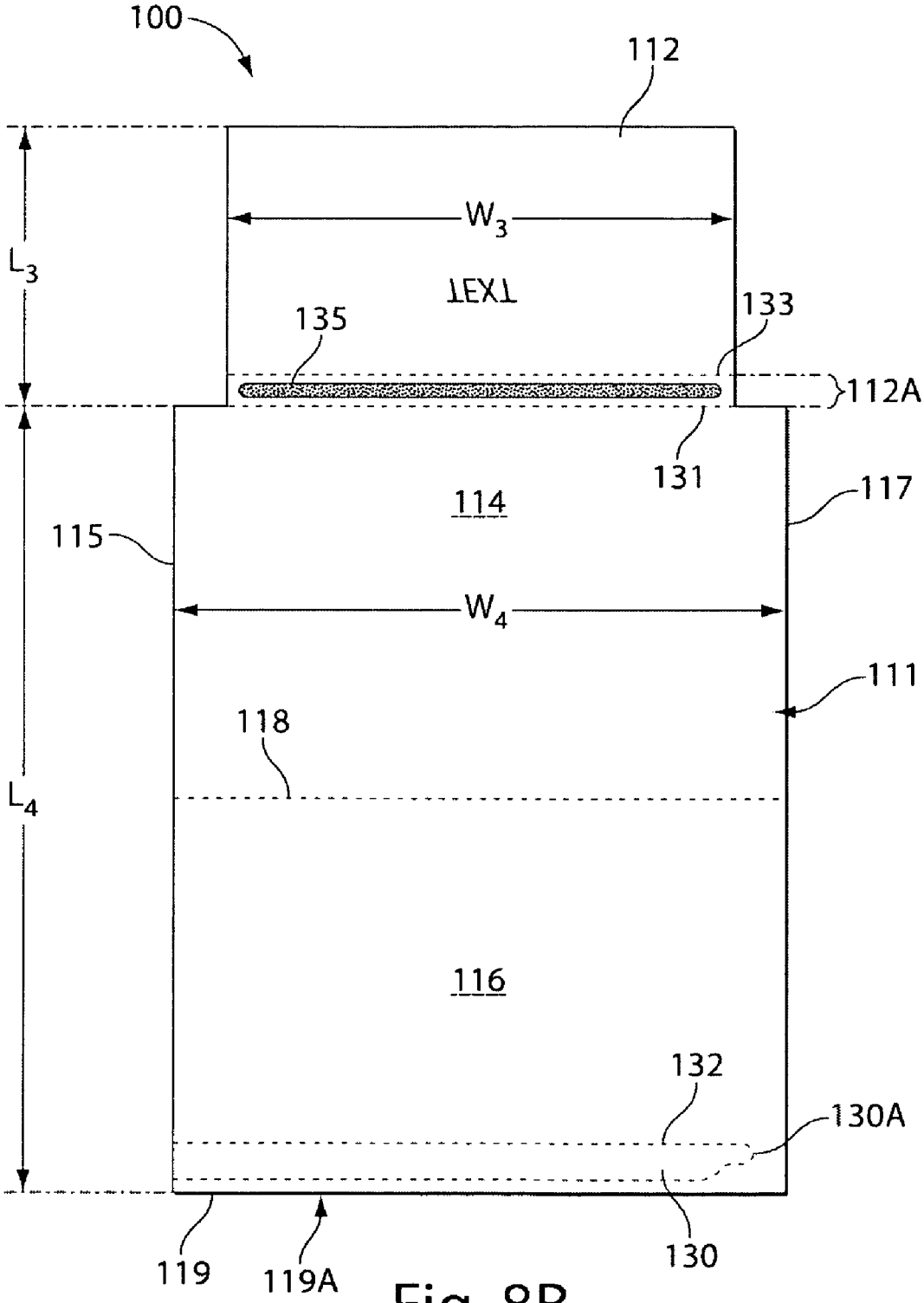

With further reference to FIGS. 8B and 9B, in an alternate configuration, the pull tab 130 can be defined by the line of perforations 132 and a second line of perforations 134, rather than the top edge 119A of the pull tab 130 along the top edge 119 of the mailer 10.

Figure 10B:
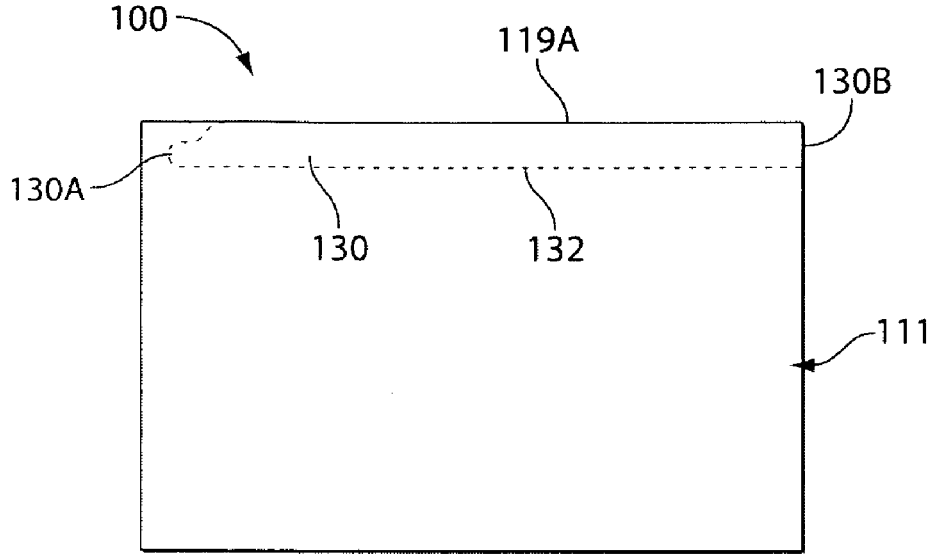
FIGS. 10B and 10C illustrate views of the mailer shown in FIGS. 8A-10A at different phases of folding.
Figure 10C:
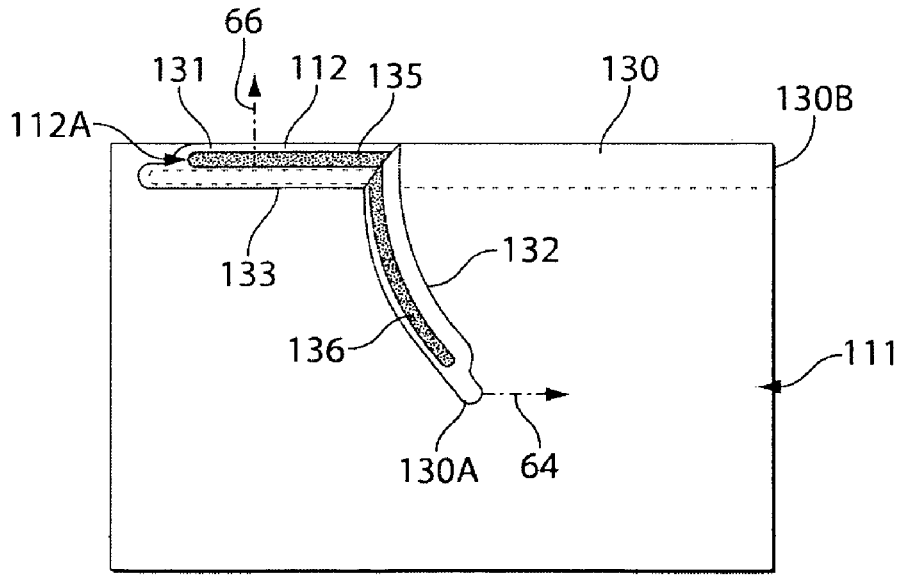

With further reference to FIGS. 10A-10C, folding and opening the mailer 100 are described. The mailer 100 is folded along the first fold line or the line of perforations 118 between the first and second panels 114 and 116 in an upward or a downward orientation relative to the top 119 of the mailer 100, as shown by arrow 62, which causes the top 119A edge of the pull tab 130 to align with the line of perforations of the insert 131. In addition, such folding about the first fold line or line of perforations 118 causes the line of perforations 132 of the pull tap tab 130 to align with the line of perforations 133 of the insert 112, while the horizontal lines of cohesive 135 and 136 align and mate with one another to secure the pull tab 130 to the insert pull tab 112A. In effect, the pull tab 130 essentially mates with the insert pull tab 112A via the horizontal lines of cohesive 135 and 136 when the mailer 100 is formed into a C-fold, Z-fold or double parallel configuration as a result of folding the mailer 100 about the lines of perforations 118.

In addition, at least a portion of the vertical lines of cohesive 124 and 126 along the first and second panels 114 and 116 mate with one another when the mailer 100 is folded about the line of perforations 118 to thereby secure the side edges 15 and 117 of the mailer 100. Depending upon the application of the mailer 100, the lines of cohesive 124 and 126 may include cohesive that fixedly secures the lines of cohesive 124 and 126 together.

As best shown in FIG. 10C, opening the mailer 100 is facilitated by removal of the pull tab 130. To begin opening, a terminal flap 130A of the pull tab 130 is lifted or otherwise separated from the mailer 100. The terminal flap 130A is configured along one end of the pull tab 30 to permit manual grasping and pulling of the pull tab 30. The terminal flap 130A may be any shape or configuration and may be defined via the line of perforations 132 and the top edge 119A of the mailer 100, or alternatively via the lines of perforations 132 and 134, to facilitate lifting or otherwise separating the terminal flap 130A from the mailer 100. Further, the terminal flap 130A may alternatively be die cut in the mailer 100 to facilitate lifting or otherwise separating of the terminal flap 130A from the mailer 100. The terminal flap 130A of the pull tab 130 is pulled in one direction, e.g., from a left side to a right side of the mailer 100, as shown by arrow 64 in FIG. 10C, along the line of perforations 132 or, alternatively, along the lines of perforations 132 and 133, to a second terminal flap 130B of the pull tab 130 to thereby remove the pull tab 130 from the mailer 100. The second terminal flap 130B is defined by the line of perforations 132, or alternatively by the lines of perforations 132 and 134, to permit ease of removal. The removal of the pull tab 130 along the line of perforations 132, or alternatively along the lines of perforations 132 and 134, simultaneously causes the pull tab 130 to tear the insert pull tab 112A along the lines of perforation 131 and 133. The pull tab 130 is pulled, for instance, in the direction shown by arrow 64 in FIG. 10C, such that it tears the insert pull tab 112A along the lines of perforations 131 and 133 in the same direction to remove the insert pull tab 112A. The insert 112 is thereby released from attachment to the mailer 100. The bond created between the horizontal lines of pressure sensitive cohesive 135 and 136 disposed along the insert pull tab 112A and the pull tab 130, respectively, is sufficiently strong to enable the pull tab 130 to pull the insert pull tab 112A along the lines of perforations 131 and 133, as described, without the pull tab 130 becoming detached from the insert pull tab 112A or without improperly tearing the insert pull tab 112A or the insert 112 attached thereto. The pull tab 130 thereby facilitates opening of the mailer 100 along the top 119 and the top edge 119A of the mailer 100 with a single manual motion, e.g., in the direction shown by arrow 64 in FIG. 10C, without requiring manual tearing or removing of tear-off stub or margin portions of the mailer 100 (to remove cohesive 124 and 126), creating a single opening for removal of the insert 112, and without damaging the insert 112 contained therein. The insert 122 may be easily removed from the interior of the mailer 100, as shown by arrow 66 in FIG. 10C, through the top 119 of the mailer 100. The side edges 115 and 117 of the mailer 100 remain securely attached by the vertical lines of cohesive 124 and 126.

Thus, the pull tab 130 is constructed to open the mailer 100, to simultaneously release the insert 112, and to enable extraction of the insert 112 through a single opening, such as through the top 119 of the mailer 100, without requiring removal of tear-off stub or margin portions or strips from the mailer 100.

Figure 11:
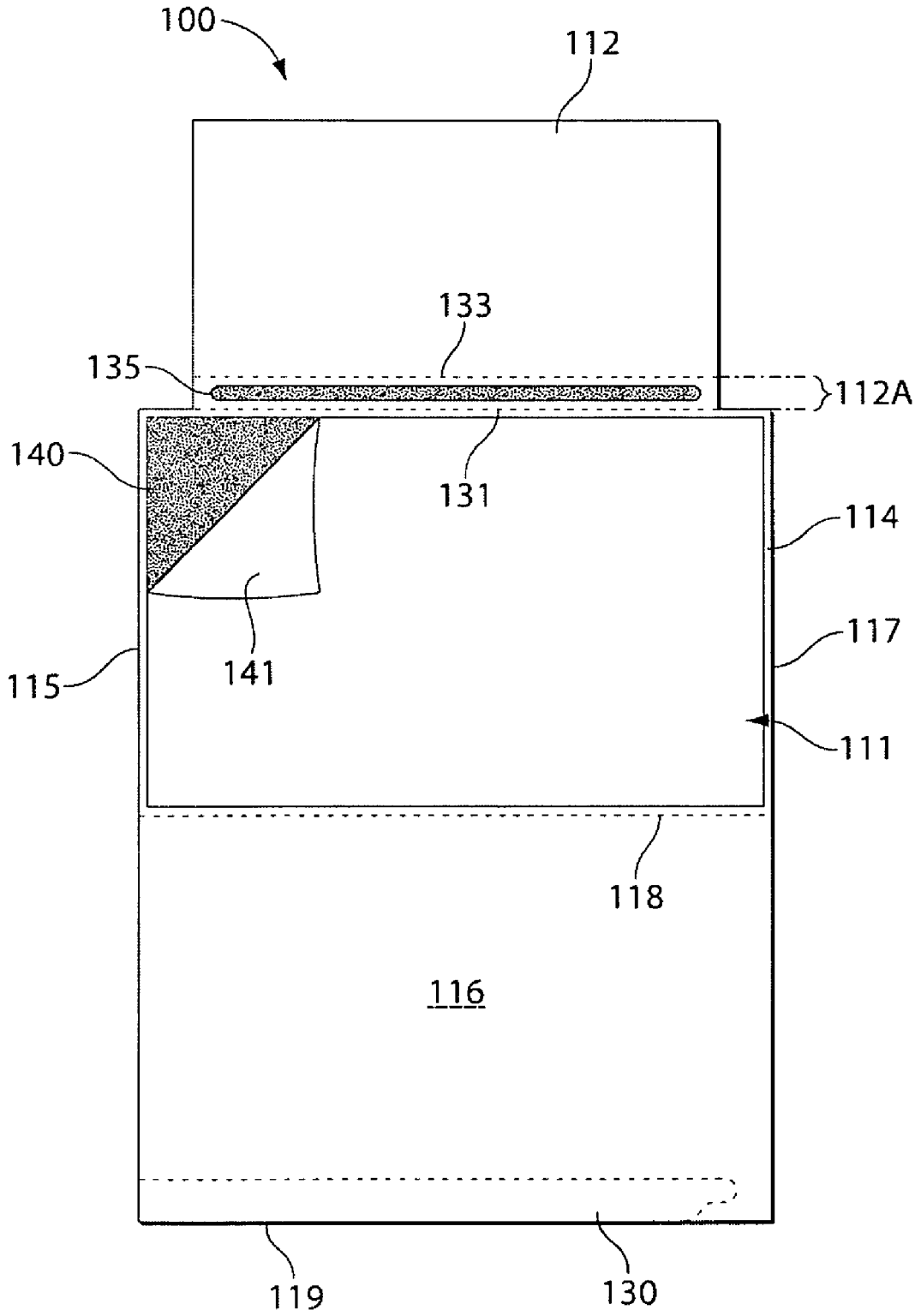
FIG. 11 illustrates a view of the mailer shown in FIGS. 8A-10C adapted to serve as a shipping form for containing an insert, such as a packing slip.

Referring to FIG. 11, the mailer 100 described above with reference to FIGS. 8A-10C, includes the mailer 100 configuration as described including other features, such as, for instance, a surface of one of the first or second panels 114 and 116 along the front or first face 111 including a layer of adhesive 140 that is covered with a removable liner 141 that protects the underlying adhesive 140. As shown in FIG. 11, the layer of adhesive 140 and the removable liner 141 are disposed on the first panel 114 along the front or first face 111 of the mailer 100 and opposite to a side of the mailer 100 in which the pull tab 130 is defined. When the mailer 100 is folded, as described above, the liner 141 may be pulled back and removed from the mailer 100 to expose the underlying layer of adhesive 140. The mailer 100 may then be secured to a substrate or surface by contacting the layer of adhesive 140 to the substrate or surface such that the mailer 100 is bonded to the substrate or surface. In this configuration, the mailer 100 may serve as a shipping/packing slip form to be affixed to an outside surface of an envelope, package or container to be shipped. In this case, the insert 112 may be configured as an invoice, gift note, and/or a packing slip that may be easily removed from the shipping form 100 by tearing the pull tab 130 as described above to remove the insert pull tab 112A and to thereby release the invoice or packing slip 112 from the interior of the shipping form 100.

Figure 12:
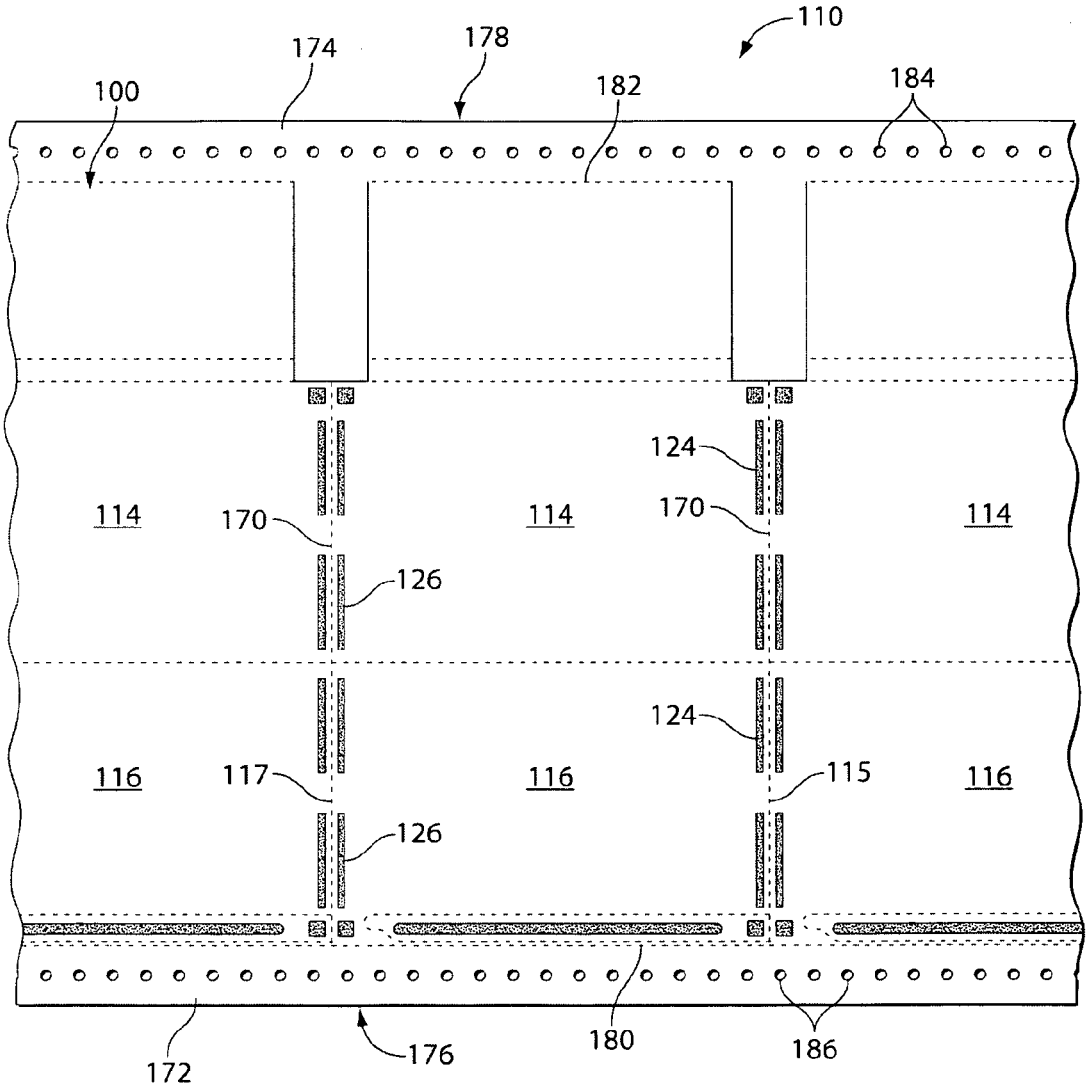
FIG. 12 illustrates a view of the mailer shown in FIGS. 8A-10C as one of multiple mailers defined in a single ply continuous web.

Referring to FIG. 12, the mailer or shipping form 100 may be produced from a single sheet of paper, as shown in FIGS. 8A-8B and 9A-9B, or may be produced from a continuous web of paper 110 whereby the mailer or shipping form 100 is attached to an adjacent mailer or shipping form 100 via a line of suitable perforations 170 between the side edge 115 and 117 of one mailer or shipping form 100 and the side edge 115 and 117 of an adjacent mailer or shipping form 100. Adjacent mailers or shipping forms 100 are separated along the line of perforations 170 during processing of the web 110, as described below, to produce individual mailers or shipping forms 100. In addition, the continuous web 110 may include at least one stub or margin portion 172 and 174 defined between an edge 176 and 178 of the web 110 and a line of suitable perforations 180 and 182 that are disposed parallel and adjacent to the edge 176 and 178 of the web 110. A linear pattern of multiple sprocket holes 184 and 186 is defined along at least one stub or margin portion 172 and 174, respectively, where each hole 184 and 186 is disposed and configured to receive at least a portion of a sprocket that helps to facilitate feeding and processing of the web 110 through various equipment and systems during the construction of the adjacent mailers 100.

Figure 13A:
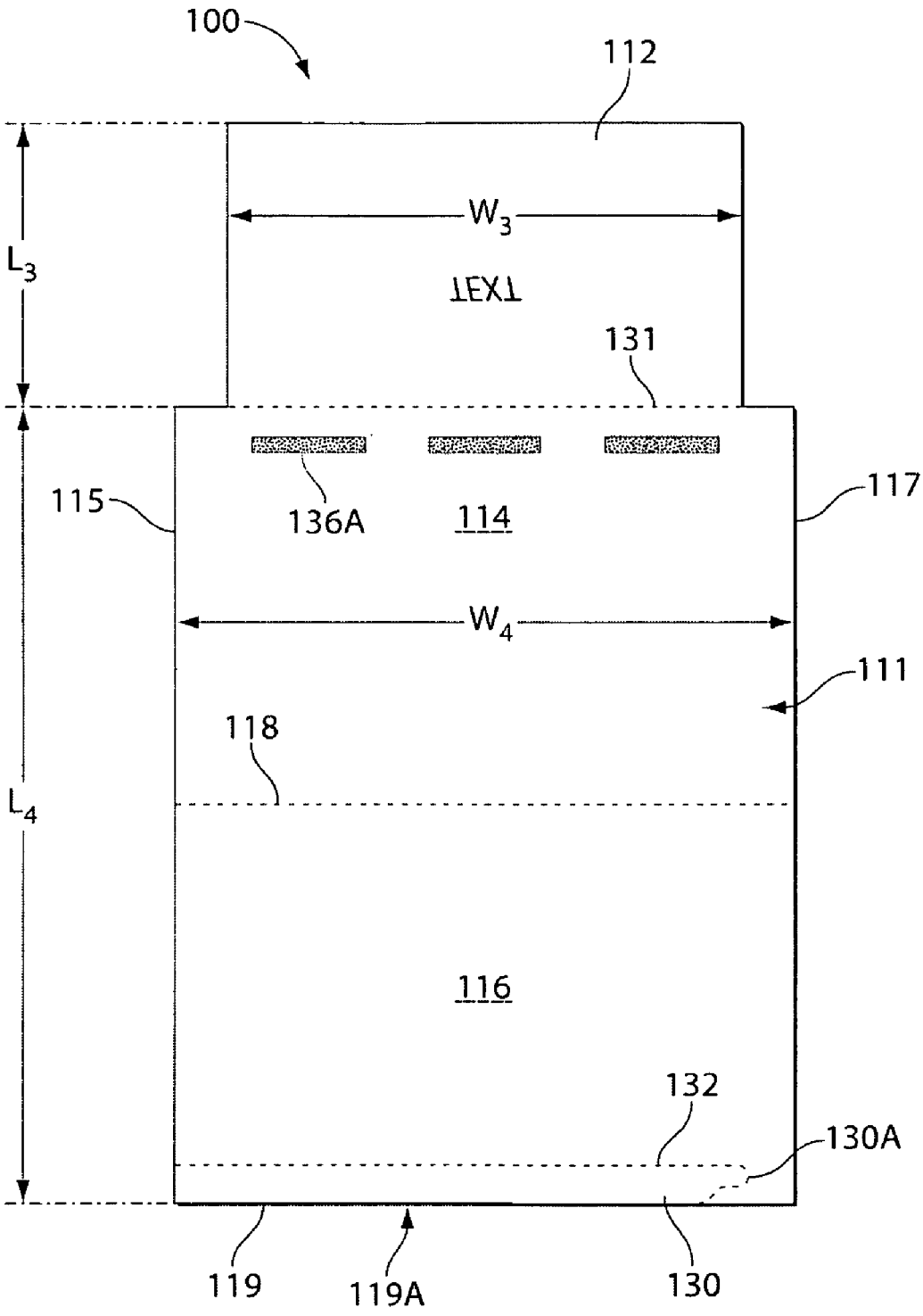
FIGS. 13A and 13B illustrate views of a variation of the mailer shown in FIGS. 8A-10C.
Figure 13B:
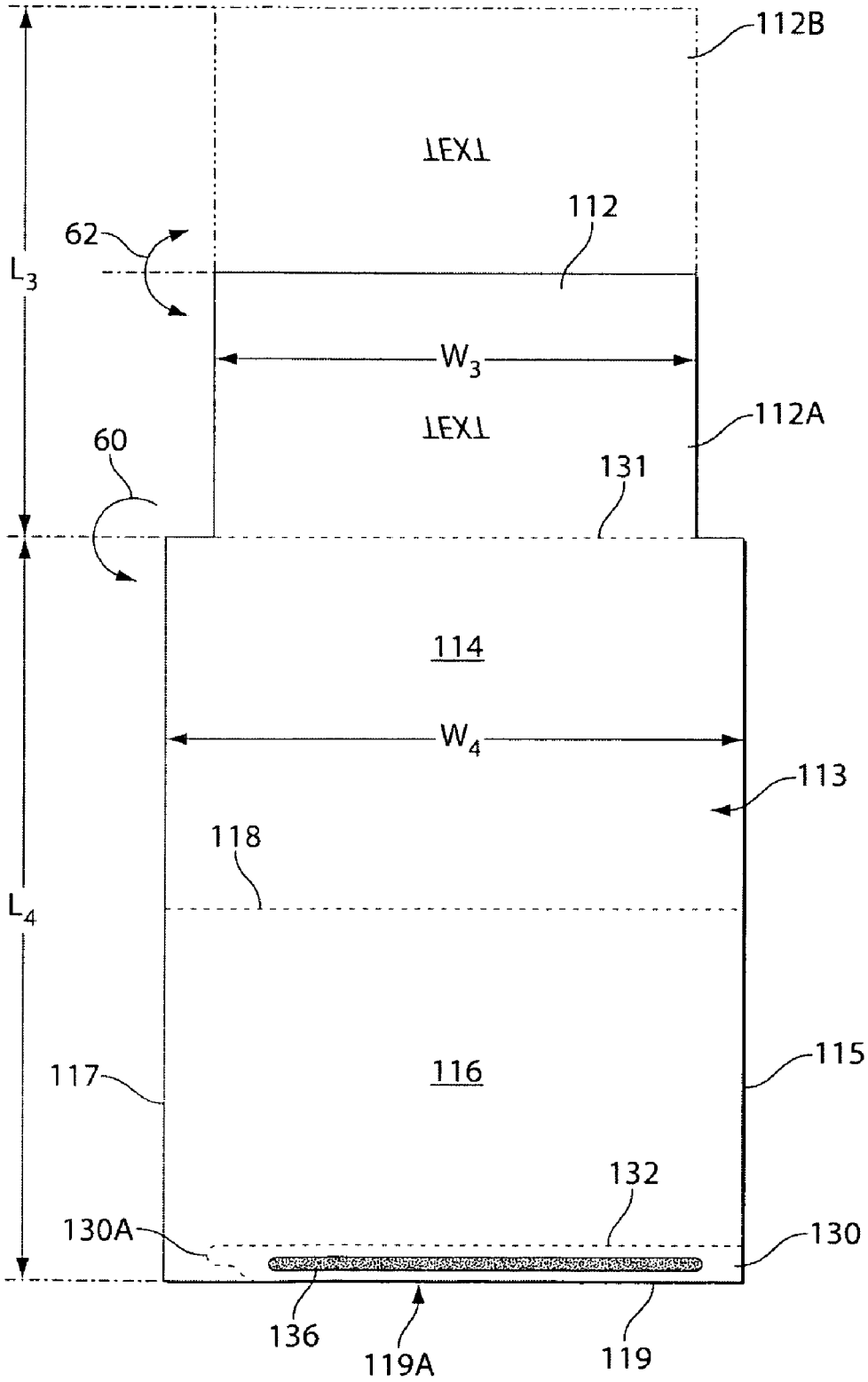

Referring to FIGS. 13A and 13B, an alternative configuration of the mailer 100 is shown that includes all of the features of the mailer 100 shown and described with reference to FIGS. 8A-12 with the exception the insert pull tab 112A and the vertical cohesive 124 and 126 are not included in the mailer 100. Rather, the mailer 100 includes the line of perforations 131 between the insert 112 and one of the panels 114 and 116 to enable removal of the insert 112 from the mailer 100. In addition, the mailer 100 further includes cohesive 136A disposed transversely along at least a portion of the width $W_4$ on the front or first face 111 of the mailer 100 and near or adjacent to the line of perforations 131. At least a portion of the cohesive 136A mates with and bonds to at least a portion of the cohesive 136 along the pull tab 130 to bond the mailer 100 when folded. Removal of the pull tab 130 causes the mailer 100 to open.

Figure 14A:
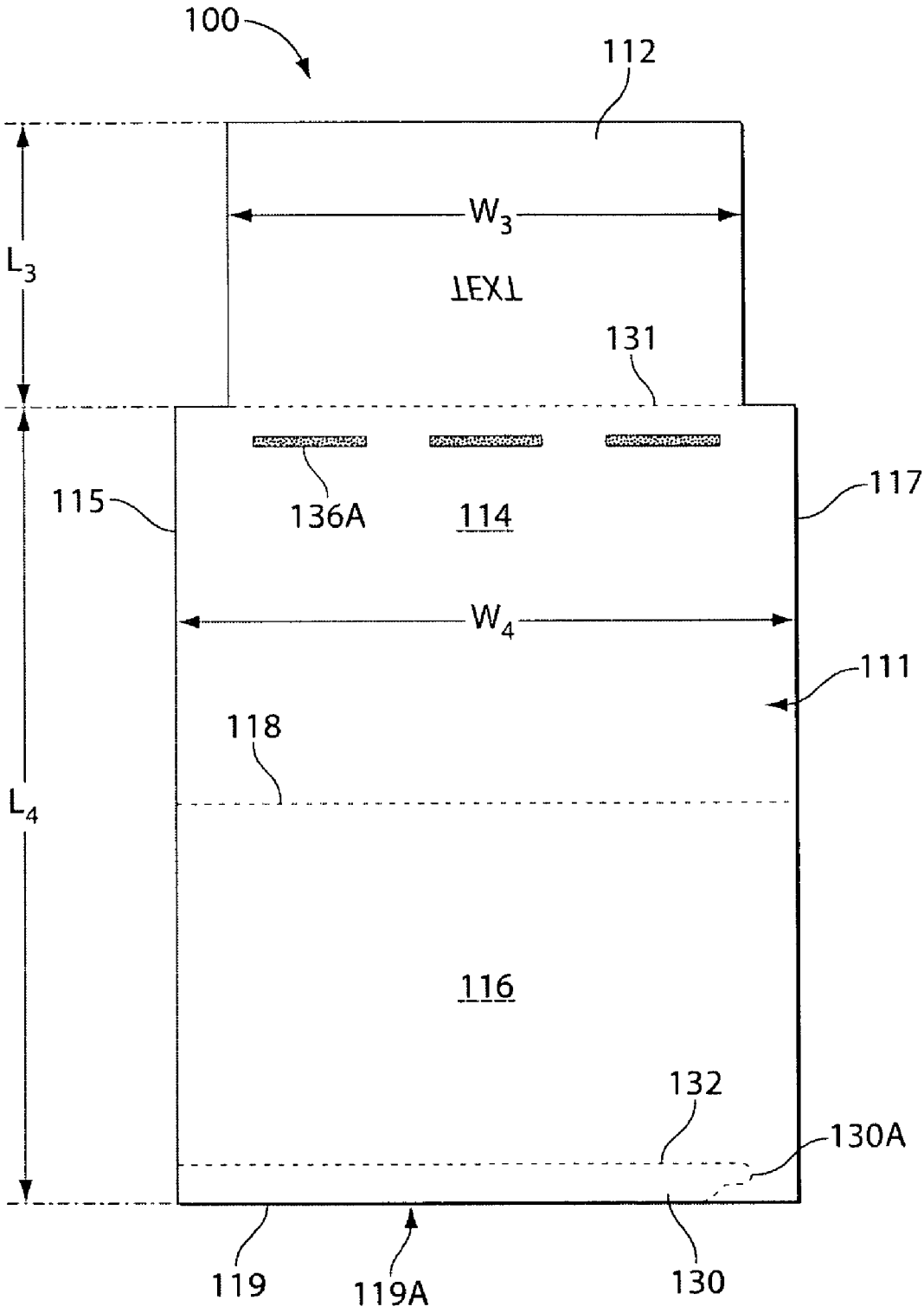
FIGS. 14A and 14B illustrate view of another variation of the mailer shown in FIGS. 8A-10C.
Figure 14B:
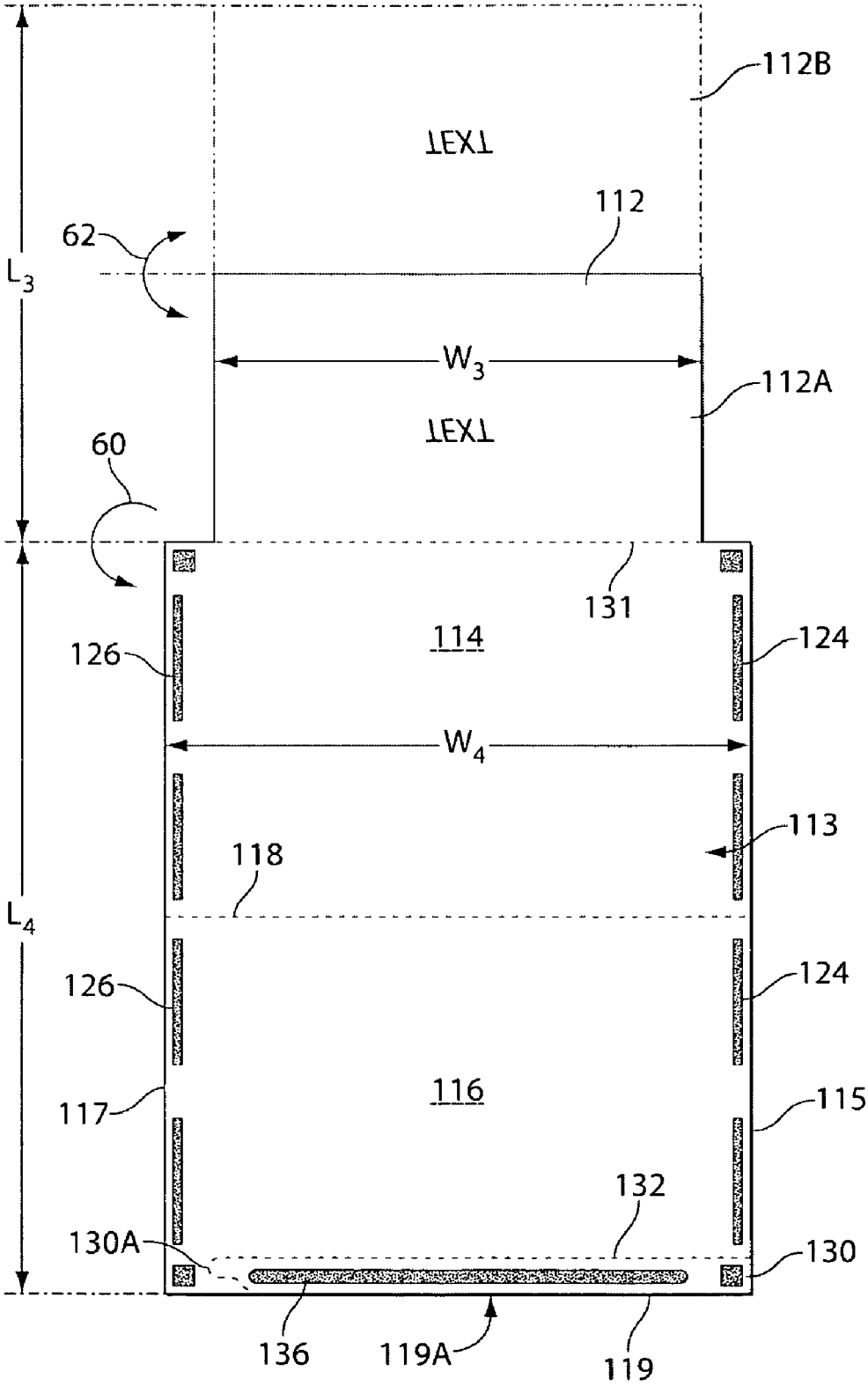

Referring to FIGS. 14A and 14B, another alternative configuration of the mailer 100 is shown that includes all of the features of the mailer 100 shown and described with reference to FIGS. 8A-12 with the exception the insert pull tab 112A is not included in the mailer 100. The mailer 100 includes, as shown and described with reference to FIGS. 13A and 13B, the cohesive 136A disposed transversely along at least a portion of the width $W_4$ on the front or first face 111 of the mailer 100 such that at least a portion of the cohesive 136A mates with and bonds to at least a portion of the cohesive 136 along the pull tab 130 when the mailer 100 is folded.

Figure 15A:
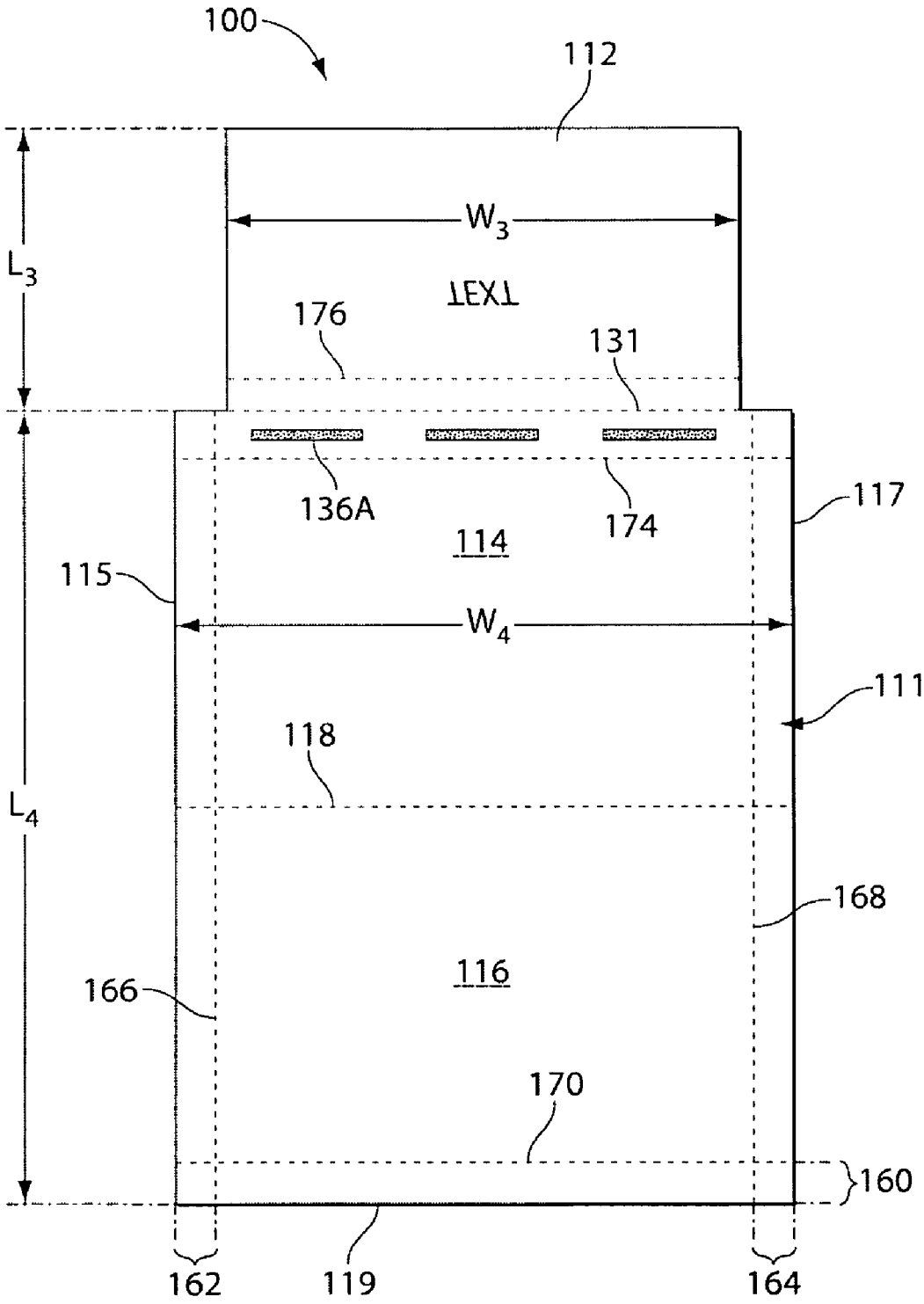
FIGS. 15A and 15B illustrate view of still a further variation of the mailer shown in FIGS. 8A-10C.
Figure 15B:
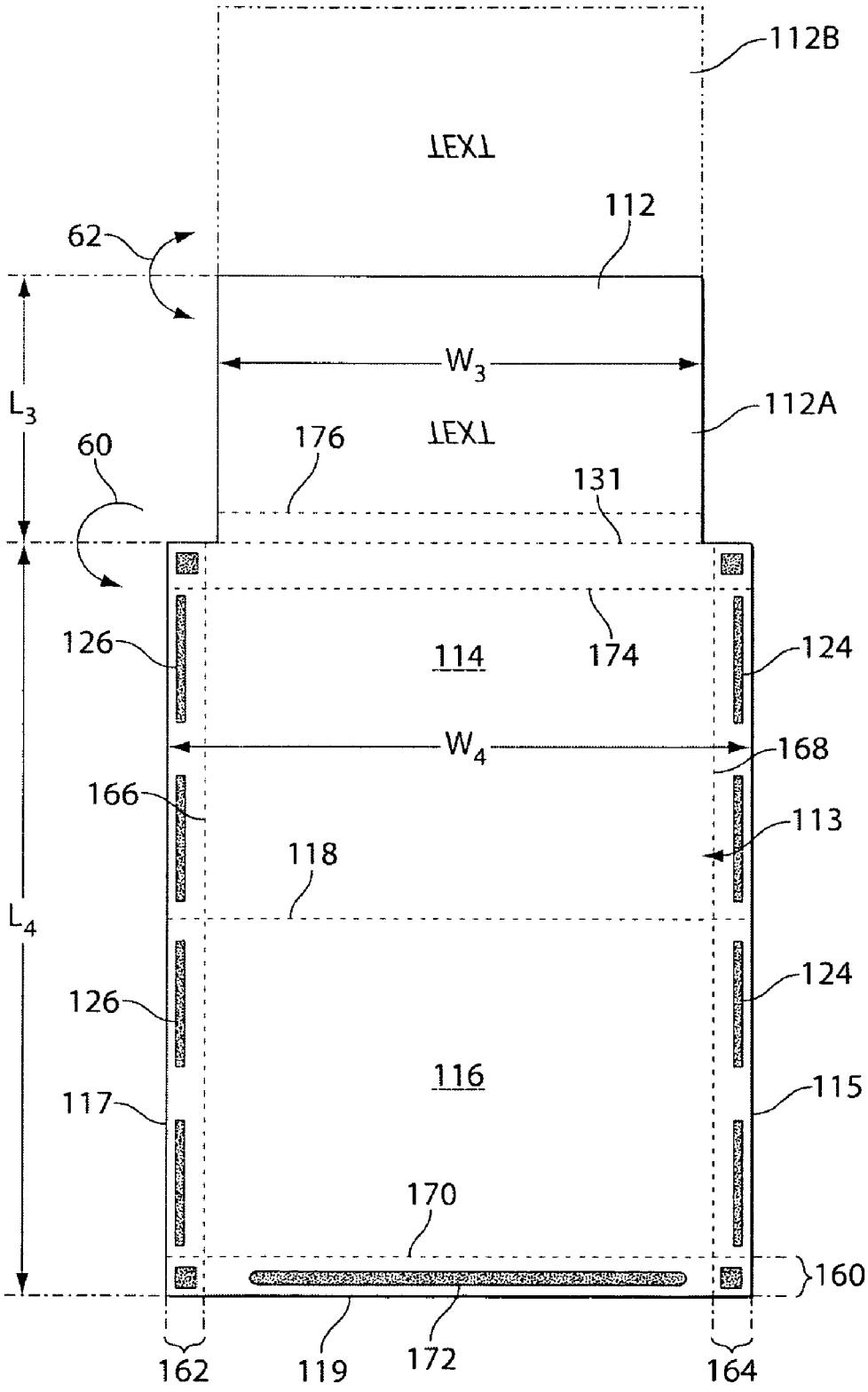

Referring to FIGS. 15A and 15B, a further alternative configuration of the mailer 100 is shown that includes all the features of the mailer shown and described with reference to FIGS. 14A and 14B with the exception the pull tab 130 is not included in the mailer 100. Rather, the mailer 100 includes along its top edge 119 a first tear-off strip 160 defined by a line of suitable perforations 170 and the top edge 119 of the mailer 100. Cohesive 172 is applied transversely on at least a portion of the width $W_4$ of the mailer 100 between the line of perforations 170 and the top edge 119 along the back or second face 113. When the mailer 100 is folded about the first fold line or line of perforations 118 to place the panels 114 and 116 in facing relation to one another along the back or second face 113, at least a portion of the cohesive 172 mates with and bonds to at least a portion of the cohesive 136A along the front or first face 111. In addition, the line of perforations 170 of the first tear-off strip 160 substantially aligns with a line of suitable perforations 174 defined in the mailer 100 along one of the panels 114 or 116 adjacent to the insert 112. The line of perforations 174 is positioned to dispose the cohesive 136A between the line of perforations 174 and an adjacent line of suitable perforations 176 defined along one or a first panel 112A of the insert 112 attached to one of the panels 114 and 116, as shown in FIG. 15A. When the insert 112 is folded inward into the panels 114 and 116 in facing relation to the back or second face 113 of the mailer 100, the line of perforations 176 substantially aligns with the lines of perforations 170 and 174 such that a tear-off strip is formed with the first tear-off strip 160, the cohesive 136A, 170, and the lines of perforations 170, 174 and 176. In addition, the mailer includes along each side edge 115 and 117 a longitudinal line of suitable perforations 166 and 168 that define a second tear-off strip 162 and a third tear-off strip 164. When the mailer 100 is folded about the first fold line or the line of perforations 118, at least a portion of the cohesive 124 and 126 along one panel 114 mates with and bonds to at least a portion of cohesive along another panel 116 and the line of weakness 166 and 168 along the one panel 114 substantially aligns with the line of weakness 166 and 168 along the another panel 116 for bond tear-off strips 162 and 164. Removal of tear-off strips 160, 162 and 164 from the folded mailer 100 along the respective lines of weakness 170, 174, 176 and 162 and 164 facilitate opening of the mailer 100 and access to the insert 112.

Having thus described at least one illustrative aspect of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A business form or intermediate comprising:

a single ply having a front or first face and a back or second face for receiving information thereon and having a top edge, a bottom edge, a first side edge and a second side edge, said single ply having a body portion defining one or more panels;

an insert portion disposed along one edge of said body portion and defining one or more panels, said insert portion having a width less than a width of one of said one or more panels of said body portion;

a first application of cohesive disposed vertically on said one or more panels of said body portion adjacent to said first side edge along said back or second face and a second application of cohesive disposed vertically on said one or more panels of said body portion adjacent to said second side edge along said back or second face;

a first pull tab defined by adjacent lines of weakness extending transversely along at least a portion of said width of one panel of said body portion, one line of weakness disposed between said one panel of said body portion and one panel of said insert portion; and said body portion and said insert portion, when folded, constructing said business form or intermediate and enclosing said first pull tab within the interior of said business form or intermediate, wherein said first pull tab is exposed when said business form or intermediate is opened or unfolded and removal of said first pull tab releases at least said one panel of said insert portion;

and further comprising a second pull tab defined by adjacent lines of weakness extending transversely along at least a portion of the width of said body portion adjacent to said top edge and wherein, when said business form or intermediate is folded, said second pull tab is disposed along the exterior of said business form or intermediate such that removal of said second pull tab from said business form or intermediate exposes said first pull tab.

2. A business form or intermediate comprising:

a single ply having a front or first face and a back or second face for receiving information thereon and having a top edge, a bottom edge, a first side edge and a second side edge, said single ply having a body portion defining one or more panels;

an insert portion disposed along one edge of said body portion and defining one or more panels, said insert portion having a width less than a width of one of said one or more panels of said body portion;

a first application of cohesive disposed vertically on said one or more panels of said body portion adjacent to said first side edge along said back or second face and a second application of cohesive disposed vertically on said one or more panels of said body portion adjacent to said second side edge along said back or second face;

a first pull tab defined by adjacent lines of weakness extending transversely along at least a portion of the width of one panel of said body portion adjacent to one panel of said insert portion, one of said lines of weakness disposed between said one panel of said body portion and said one panel of said insert, said first pull tab having a third application of cohesive disposed between said adjacent lines of weakness;

a second pull tab defined by adjacent lines of weakness extending transversely along at least a portion of the width of said body portion and adjacent to said top edge, said second pull tab having a fourth application of cohesive disposed between said lines of weakness; and said body portion and said insert portion, when folded, constructing said business form or intermediate and at least a portion of said third application of cohesive mating with and bonding to at least a portion of said fourth application of cohesive to bond said first and second pull tabs, said first pull tab being contained within the interior of said business form or intermediate and said second pull tab being disposed along the exterior of said business form or intermediate, wherein removal of said second pull tab from said business form or intermediate removes said first pull tab from said insert portion to release at least one panel of said insert portion from within the interior of said business form or intermediate.

3. A business form or intermediate comprising:

a single ply having a front or first face and a back or second face for receiving information thereon and having a top edge, a bottom edge, a first side edge and a second side edge, said single ply having a body portion defining one or more panels;

an insert portion disposed along one edge of said body portion and defining one or more panels, said insert portion having a width less than a width of one of said one or more panels of said body portion;

a first application of cohesive disposed vertically on said one or more panels of said body portion adjacent to said first side edge along said back or second face and a second application of cohesive disposed vertically on said one or more panels of said body portion adjacent to said second side edge along said back or second face;

a first pull tab defined by adjacent lines of weakness extending transversely along at least a portion of the width of one panel of said insert portion, one of said lines of weakness disposed between said one panel of said insert portion and one panel of said body portion; said first pull tab having a third application of cohesive disposed between said adjacent lines of weakness;

a second pull tab defined by adjacent lines of weakness extending transversely along at least a portion of the width of said body portion and adjacent to said top edge, said second pull tab having a fourth application of cohesive disposed between said lines of weakness; and said body portion and said insert portion, when folded, constructing said business form or intermediate and at least a portion of said third application of cohesive mating with and bonding to at least a portion of said fourth application of cohesive to bond said first and second pull tabs, said first pull tab being contained within the interior of said business form or intermediate and said second pull tab being disposed along the exterior of said business form or intermediate, wherein removal of said second pull tab from said business form or intermediate removes said first pull tab from said insert portion to release at least one panel of said insert portion from within the interior of said business form or intermediate.

* * * * *